US006379125B1

(12) United States Patent
Tojo et al.

(10) Patent No.: US 6,379,125 B1
(45) Date of Patent: Apr. 30, 2002

(54) LINEAR COMPRESSOR

(75) Inventors: Naoto Tojo, Ikoma; Shinichi Matsumura, Kadoma; Yasuyuki Kuwaki, Higashiosaka; Takafumi Nakayama, Kobe; Taizo Takaoka, Takatsuki, all of (JP)

(73) Assignee: Sanyo Electric Co., Ltd., Osaka (JP)

( * ) Notice: Subject to any disclaimer, the term of this patent is extended or adjusted under 35 U.S.C. 154(b) by 36 days.

(21) Appl. No.: 09/677,773

(22) Filed: Oct. 3, 2000

Related U.S. Application Data

(62) Division of application No. 09/029,636, filed as application No. PCT/JP97/02360 on Jul. 8, 1997, now Pat. No. 6,231,310.

(30) Foreign Application Priority Data

| | | |
|---|---|---|
| Jul. 9, 1996 | (JP) | 8-179492 |
| Jul. 24, 1996 | (JP) | 8-194989 |
| Aug. 30, 1996 | (JP) | 8-230841 |
| Oct. 11, 1996 | (JP) | 8-270044 |
| Feb. 14, 1997 | (JP) | 9-030584 |
| Feb. 14, 1997 | (JP) | 9-030752 |
| Feb. 14, 1997 | (JP) | 9-030753 |

(51) Int. Cl.[7] ..... F04B 35/04
(52) U.S. Cl. ..... 417/417
(58) Field of Search ..... 417/44.1, 410.1, 417/414, 415, 416, 417

(56) References Cited

U.S. PATENT DOCUMENTS

| | | | | |
|---|---|---|---|---|
| 4,067,667 A | | 1/1978 | White | |
| 4,345,442 A | | 8/1982 | Dorman | |
| 4,353,220 A | | 10/1982 | Curwen et al. | |
| 4,750,871 A | | 6/1988 | Curwen | |
| 5,275,542 A | * | 1/1994 | Terauchi | 417/417 |
| 5,597,294 A | * | 1/1997 | McGrath | 417/417 |
| 5,727,932 A | * | 3/1998 | McGrath | 417/417 |
| 5,897,296 A | | 4/1999 | Yamamoto et al. | |
| 6,015,273 A | * | 1/2000 | Hannagan et al. | 417/417 |
| 6,089,836 A | * | 7/2000 | Seo | 417/417 |

FOREIGN PATENT DOCUMENTS

| | | |
|---|---|---|
| EP | 0161429 A | 11/1985 |
| JP | 43-18497 | 8/1968 |
| JP | 53-27214 | 3/1978 |
| JP | 53-65007 | 6/1978 |
| JP | 59-160079 | 9/1984 |
| JP | 59-192873 | 11/1984 |
| JP | 2-154950 | 6/1990 |
| JP | 4-335962 | 11/1992 |
| JP | 5-288419 | 2/1993 |
| JP | 7-6701 | 7/1995 |
| JP | 9-137781 | 5/1997 |
| WO | WO86/05927 | 10/1986 |

* cited by examiner

*Primary Examiner*—Erick Solis
(74) *Attorney, Agent, or Firm*—Armstrong, Westerman, Hattori, McLeland & Naughton, LLP

(57) ABSTRACT

A linear compressor according to the invention is for generating compressed gas and includes two pairs of pistons 608*a*, 608*b* and cylinders 607*a* and 607*b* coaxially provided and facing opposite to each other, a shaft 603 having pistons 608*a* and 608*b* at its ends, coil springs 605*a* and 605*b* coupled to shaft 603 for returning a piston departed from a neutral point to the neutral point, and a linear motor 613 for causing shaft 603 to axially move back and forth, thereby generating compressed gas alternately in two compression chambers 611*a* and 611*b*.

Thus, the non-linear force of the compressed gas acting upon the pistons may be divided into two/reversed in phase. As a result, as compared to a conventional structure having only a single piston, the motor thrust may be reduced and linearized for the purpose of improving the efficiency. Furthermore, the size of the device may be reduced as well as the vibration/noises caused thereby may be reduced.

4 Claims, 27 Drawing Sheets

REEXPANSION / TAKING IN PROCESS

COMPRESSION / LETTING OUT PROCESS

LINEAR COMPRESSOR

This application is a division of prior application Ser. No. 09/029,636 filed Mar. 6, 1998, now U.S. Pat. No. 6,231,310 which is a national stage application under §371 of international application PCT/JP97/02360 filed Jul. 8, 1997.

FIELD OF THE INVENTION

The present invention relates to a linear compressor which compresses and externally supplies gas by driving a piston fit within a cylinder to move back and forth by a linear motor.

BACKGROUND OF THE INVENTION

In recent years, there have been developed linear compressors as a mechanism for compressing and supplying refrigerant gas in a refrigeration system. As shown in FIG. 26, for example, a linear compressor includes a is cylindrical housing 101 having a bottom, a magnetic frame 102 of a low carbon steel formed at the upper end opening of housing 101, a cylinder 103 formed in the central portion of magnetic frame 102, a piston 105 fit within cylinder 103, capable of moving back and forth and defining a compression chamber 104 in the space of cylinder 103, and a linear motor 106 serving as a driving source to drive piston 105 to reciprocate.

Linear motor 106 has an annular permanent magnet 107 provided at an outer concentric position with cylinder 103 and fixed to housing 101. A magnetic circuit formed of magnet 107 and magnetic frame 102 produces a magnetic field B in a cylindrical gap 108 concentric with the center of cylinder 103. A cylindrical mobile body 109 having a bottom, formed of resin and integrally fixed to piston 105 is provided in gap 108 in the center, and a coil spring 110 for elastically supporting mobile body 109 and piston 105 and permitting them to reciprocate is fixed to housing 101.

An electromagnetic coil 110 is wound around the outer circumference of mobile body 109 at a position opposite to magnet 107, ac current at a prescribed frequency is passed through a lead (not shown) to drive coil 111 and mobile body 109 by the function of a magnetic field through gap 108 to force piston 105 to move back and forth within cylinder 103, and gas pressure is generated at a prescribed cycle in compression chamber 104.

Meanwhile, as shown in FIG. 27, there is known, as a representative refrigerating system, a closed a type refrigerating system in which a linear compressor 121 (compressor), a condenser 122, an expansion valve 123 and an evaporator 124 are connected by a gas flow path pipe 125. Linear compressor 121 is used as a device to compress to a high pressure a refrigerant gas evaporated at evaporator 124 and taken in through gas flow path pipe 125, and let out thus pressurized refrigerant gas to condenser 122 through gas flow path pipe 125.

Therefore, as shown in FIG. 26, compression chamber 104 is connected with gas flow path pipe 125 outside housing 101 through a valve mechanism 112 provided at the upper end portion of cylinder 103. Valve mechanism 112 includes an inlet valve 112*a* which permits only refrigerant gas from evaporator 124 to enter through gas flow path pipe 125, and an outlet valve 112*b* which permits only refrigerant gas to be let out to condenser 122 through gas flow path pipe 125. Inlet valve 112*a* allows gas to flow toward compression chamber 104 by the difference in pressure of refrigerant gas between gas flow path pipe 125 on the low pressure side and compression chamber 104.

Outlet valve 112*b* allows gas to flow toward gas flow path pipe 125 on the high pressure side by the difference in pressure of refrigerant gas between compression chamber 104 and gas flow path pipe 125 on the high pressure side. Note that inlet valve 112*a* and outlet valve 112*b* are both energized by a plate spring.

Thus, in the conventional device, refrigerant gas taken in from inlet valve 112*a* is compressed to a high pressure in compression chamber 104, and supplied to condenser 122 through outlet valve 112*b*.

In addition, in recent years, as disclosed by Japanese Patent Laying-Open No. 2-154950, for example, there has been proposed a technique of improving the efficiency by providing compression chambers on both sides in a housing and alternately operating two pistons by a single linear motor.

The linear compressors are divided into two kinds, in other words, those like a coil mobile linear compressor as disclosed by Japanese Patent Application No. 8-179492, and those like a magnet mobile type linear compressor as disclosed by Japanese Patent Application No. 8-108908. These two kinds of linear compressors both produce compressed gas in a compression chamber by driving a piston to move back and forth using a driving force obtained from a linear motor.

The above-described linear compressors are, however, encountered with various problems as follows.

First Problem

The conventional single piston type linear compressor is largely affected by non-linear force produced within a compression chamber associated with in taking/compression/exhaustion of a gas, and the thrust of the motor cannot be linearized, which makes it difficult to improve the efficiency.

Furthermore, the neutral point of the piston fluctuates with the fluctuation of load at the time of activation for example, and the stroke of the piston cannot be readily controlled.

Second Problem

In conventional linear compressor 121, piston 105 is driven by linear motor 106 to move up and down within cylinder 103, and mobile body 109 also moves up and down, which causes gas present in the space in the magnetic circuit formed by magnetic frame 102, permanent magnet 107 and mobile body 109 and gas present in the space inside the mobile body on the back side of piston 105 surrounded by the inner surface portion of mobile body 109 perform compression/expansion work as mobile body 109 moves up and down, which could lead to irreversible compression losses in linear compressor 121.

As a countermeasure, gap 108 may be sufficiently secured to provide a sufficient gap between magnetic frame 102 and mobile body 109 and between permanent magnet 107 and electromagnetic coil 111, but the thrust of linear motor 106 decreases in this case, which lowers the operation efficiency of linear compressor 121.

Third Problem

In linear compressor 121 as described above, piston 105 is driven by linear motor 106 to move up and down within and slidably in contact with cylinder 103, and a kind of slide bearing is formed between the piston and the cylinder.

In the conventional structure as described above, however, a force (radial force) in the direction vertical to the moving direction of the piston is generated because of the problem of processing precision and a distortion in the electromagnetic force of the electromagnetic coil, and if the radial force is large, the operation efficiency may be lowered because of frictional losses, the life of the device may be shortened because of abrasion at a gas seal portion provided at piston 105, and the refrigerant may be contaminated by dust created by abrasion.

Fourth Problem

The linear compressor disclosed by Japanese Patent Laying-Open No. 2-154950 employs a magnet mobile type linear motor driving method rather than the coil mobile type as described above and shown in FIG. 26, force by magnetic field in the direction vertical to the moving direction of the piston is applied to the piston, the piston portion is prone to abrasion and therefore the compressor is not suitable for such use.

Therefore, in a linear compressor to be used for a long period of time, the driving method of the linear motor may be changed to the coil mobile type according to which force by the magnetic field of the linear motor acts only in the same direction as the mobile direction of the piston.

Furthermore, gas present in the back space of the piston performs compression/expansion work as the piston moves back and forth, which could lead to irreversible compression losses in linear compressor 121.

In addition, in the conventional linear compressor, the central position of the stroke of piston cannot be controlled at a prescribed position, and therefore highly efficient operation cannot be performed.

Fifth Problem

In the refrigerating system as described above, compressed gas obtained in the compression chamber of the linear compressor is supplied to condenser 122 from outlet valve 112*b* through gas flow path pipe 125, vibration noise in the pipe caused by the pulsation of the gas or valve operation noise are generated at the time of opening/closing outlet valve 112*b*, and therefore there should be provided an outlet muffler 131 for controlling noise in the pipe on the downstream side of outlet valve 112*b*.

The above-described 2-piston type linear compressor must be provided with two such outlet mufflers for noise control, and two outlet pipes must be coupled preceding to condenser 122, which could increase the size of the entire device.

Sixth Problem

In the refrigerating system as described above, the piston is permitted to move back and forth in the cylinder, and a coil spring is often used as a member for elastically supporting the piston to the housing. In recent years, a plate shaped piston spring has been proposed which is advantageous over a conventional coil spring in terms of durability and positional restriction in the mobile direction, and various attempts have been made for improvements thereof (T. Haruyama, et al.: Cryogenic Engineering 1992 fall lecture meeting B2-4, p166).

The plate shaped piston spring is generally called "suspension spring", and has a disk shaped plate spring 920*a* having a plurality of spiral cut out portions 920*b* equidistantly provided toward the central portion as shown in FIG. 28.

Using plate shaped suspension spring 120 as the piston spring, the stroke central position of the piston can be fixed by a simple device.

Plate shaped suspension spring 920, however, cannot restrict the deviation of the axis of the piston in the vicinity of upper and lower supporting points of the piston where the spring is fully extended. As a result, the piston may locally abut against the cylinder for some reasons and abrasion may be caused at the piston portion.

Seventh Problem

Meanwhile, the magnet mobile type linear compressor as disclosed by Japanese Patent Application No. 8-108908 may be advantageously formed into a compact shape, but since attracting force by magnetic force is used as the driving force of the linear motor to force the piston to move up and down, force in the direction vertical to the upward and downward movement of the piston is likely to be generated. The driving force is lost because of friction between the piston and the cylinder and friction at the bearing portion of the shaft supporting the piston, which lowers the efficiency. Therefore, an expensive gas bearing or the like should be used for the bearing portion of the shaft supporting the piston.

The coil mobile type linear compressor as disclosed by Japanese Patent Application No. 8-179492 on the other hand employs Lorentz force as the driving force of the linear motor, and therefore the deviation of the axis is less likely as compared to the magnet mobile type linear compressor. In order to obtain the same output as by the magnet mobile type linear compressor, however, the device is generally increased in size.

It is therefore a first object of the invention to provide a highly efficient linear compressor which permits the stroke of a piston to be readily controlled.

Then, a second object of the invention is to provide a linear compressor whose efficiency is improved by reducing a gap in a magnetic circuit during the reciprocating movement of a mobile body as much as possible and preventing an irreversible compression loss.

Then, a third object of the invention is to provide a linear compressor whose efficiency is improved and whose life is prolonged.

Then, a fourth object of the invention is to provide a linear compressor having compression chambers on both sides in a housing, and compressing and externally supplying gas by driving a coil mobile type linear motor, wherein an irreversible compression loss is prevented in the back space of the piston by a simple structure, and the stroke central position of the piston is fixed.

Then, a fifth object of the invention is to provide a linear compressor having compression chambers on both sides in a housing, and compressing and externally supplying gas by driving a coil mobile type linear motor, wherein the stroke central position of the piston is fixed by a simple structure, abrasion at the piston portion is prevented by restricting the deviation of the axis of the piston when the piston is driven to reciprocate, and the life of the device is prolonged.

A sixth object of the invention is to provide a linear compressor which permits prevention of loss in the driving force, caused by friction between a piston and a cylinder and friction at the bearing portion of a shaft supporting the piston and the size of the device to be reduced.

DISCLOSURE OF THE INVENTION

A linear compressor according to a first aspect of the invention for generating a compressed gas includes two pairs of pistons and cylinders provided coaxially and facing opposite to each other, a shaft provided with a piston at each of its both ends, an elastic member coupled to the shaft for returning the piston departed from the neutral point to the neutral point, and a linear motor for forcing the shaft to axially move back and forth to generate a compressed gas alternately by the two pairs of pistons and cylinders.

Thus, the non-linear force of the compressed gas acting upon the pistons can be divided into two/reversed in phase.

As a result, as compared to a conventional structure provided only with a single piston, the motor thrust may be reduced and linearized, which improves the efficiency. Furthermore, the size of the device may be reduced, and vibration/noises may be reduced as well. In addition, the position of the neutral point of the piston does not fluctuate if the load fluctuates, the stroke of the piston may be readily controlled simply by controlling the driving current of the linear motor.

Furthermore, more specifically, a vibrating portion including the two pistons, the shaft and the elastic member has a predetermined resonant frequency, and the linear motor forces the shaft to reciprocate at the resonant frequency.

Thus, the shaft may be reciprocated at the resonant frequency of the vibrating portion, which further improves the efficiency.

In addition, more specifically, the regaining force of the elastic member to return the piston departed from the neutral point to the neutral point is set larger than the force of the compressed gas acting upon the piston.

Thus, the non-linear force of the compressed gas acting upon the piston may be restricted to a small level, which further improves the linearity of the motor thrust.

A linear compressor according to a second aspect of the invention includes a cylinder provided within a housing, a piston fit within the cylinder, capable of moving back and forth and defining a compression chamber within the cylinder, a linear motor having a cylindrical mobile body with a bottom fixed integrally to the piston at the central portion and provided in a gap formed in part of a magnetic circuit of a magnet and a magnetic frame for driving the piston to move back and forth by supplying ac current at a prescribed frequency to an electromagnetic coil wound around the outer circumference of the mobile body. The linear compressor externally supplies gas compressed within the compression chamber and has a gas leaking device provided at the mobile body and/or the magnetic frame.

Thus providing the gas leaking device at the mobile body and/or magnetic frame may prevent an irreversible compression loss associated with the reciprocating movement of the mobile body.

More specifically, the structure of the gas leaking device includes a first leak hole provided at the magnetic frame for leaking gas, a buffer space portion communicated with the first leak hole, and a second leak hole provided at the mobile body for leaking gas.

The use of the structure prevents compression/expansion work of gas in the space portion of the magnetic circuit formed by the magnetic frame, permanent magnet and mobile body and in the inner space portion of the mobile body surrounded by the rear side of the piston and the inner portion of the mobile body.

Furthermore, the compressor according to this aspect further includes a piston shaft provided between the piston and the mobile body, a spring receiving portion provided at the cylinder on the rear surface of the piston and having the piston shaft fit being capable of moving back and forth therein, a first coil spring fit into the piston shaft and provided between the spring receiving portion and the mobile body, a second coil spring provided between the bottom surface of the housing and the mobile body, and a third leak hole for leaking gas to communicate the rear surface space portion of the piston and the mobile body inner space portion having the first coil spring wound therearound.

Use of the structure wherein the first and second coil springs are provided on both sides through the mobile body permits the stroke central position of the piston to be readily stably controlled in a fixed manner, and permits the spring constant to be set larger than the conventional cases within the same device dimension. In addition, gas compression/expansion work may be prevented in the piston rear surface space in association with the upward and downward movement of the piston.

A linear compressor according to a third aspect of the invention includes a cylinder provided within a housing, a piston fit within the cylinder with a fine gap, capable of moving back and forth and defining a compression chamber within the cylinder, a piston shaft having one end portion fixed to the piston, a linear motor in which a cylinder mobile body with a bottom integrally fixed to the piston shaft is provided at a gap formed at a part of a magnetic circuit formed of a magnet and a magnetic frame and which drives the piston to move back and forth by supplying ac current at a prescribed frequency to an electromagnetic coil wound around the outer circumference of the mobile body, and a rolling bearing at the inner circumference, and there is provided a guide portion for slidably retaining the piston shaft at the rolling bearing.

By using the structure, the piston shaft is directly supported by the rolling bearing so that the direction of the linear movement of,the piston is defined, and therefore, clearance seal may be achieved between the piston and cylinder.

More specifically, the fine gap as described above is within the range in which a gas seal is formed to the cylinder in association with the reciprocating movement of the piston, and is preferably set not more than 5 $\mu$m.

The guide portion is formed of a first guide portion provided at the cylinder on the rear side of the piston and a second guide portion provided at the bottom surface of the housing and includes a first coil spring provided between the first guide portion and the mobile body and a second coil spring provided between the second guide portion and the mobile body.

Use of the structure permits the stroke central position of the piston to be controlled readily stably and permits the spring constant within the same device dimension to be set larger than the conventional cases.

A linear compressor according to a fourth aspect of the invention includes a cylinder provided within a housing, a piston fit within the cylinder, capable of moving back and forth, and defining a compression chamber within the cylinder, a piston shaft having one end portion fixed to the piston, and a linear motor in which a cylindrical mobile body having a bottom integrally fixed to the piston shaft is provided in a gap formed at a part of a magnetic circuit formed of a magnet and a magnetic frame and which drives the piston to move back and forth by supplying ac current at a prescribed frequency to an electromagnetic coil wound around the outer circumference of the mobile body. The linear compressor externally supplies gas compressed within the compression chamber and is provided with a rolling bearing at the cylinder or the piston, through which the piston is moved back and forth along the cylinder.

Use of this structure permits the piston to slide along the cylinder through the rolling bearing, there is no necessity to provide a gas seal member at the piston, and therefore degradation in the operation efficiency by friction loss between the piston and the cylinder as the piston moves back and forth may be prevented.

More specifically, the structure includes a spring receiving portion provided at the cylinder on the rear surface of the piston, to which the piston shaft is freely fit and capable of moving back and forth, a first coil spring provided between the spring receiving portion and the mobile body, and a second coil spring provided between the bottom surface of the housing and the mobile body.

Use of this structure permits the stroke central position of the piston to be controlled readily stably, and permits the spring constant within the same device dimension to be set larger than the conventional cases.

Now, a linear compressor according to a fifth aspect of the invention for compressing gas within a compression chamber and externally supplying the compressed gas includes first and second cylinders provided on both sides within a housing, first and second pistons fit, capable of moving back and forth within the first and second cylinders and defining compression chambers within the first and second cylinders, respectively, a piston shaft having end portions fixed to the first and second pistons, a linear motor in which a cylindrical mobile body with a bottom integrally fixed to the piston shaft is provided in a gap formed at a part of a magnetic circuit formed of a magnet and a magnetic frame and which drives the piston to move back and forth by supplying ac current at a prescribed frequency to an electromagnetic coil wound around the outer circumference of the mobile body, coil springs provided having the mobile body therebetween for elastically supporting the first and second pistons so that they can move back and forth within the first and second cylinders, respectively, the insides of the first piston, piston shaft and second piston are hollow and communicated with each other, and the rear surface space of the first piston and the rear surface space of the second piston are communicated with each other.

Use of this structure permits gas in the rear surface portion to be communicated through the first piston, piston shaft and second piston in association with the reciprocating movement of the first and second pistons, no compression/expansion work is performed and therefore no irreversible compression loss is caused. In addition, in the linear compressor having compression chambers on both sides of the housing, by providing coil springs on both sides through the mobile body, the stroke central positions of the first and second pistons may be readily controlled stably, so that a prescribed spring constant may be established.

Furthermore, the rear surface space of the first piston and the rear surface space of the second piston are communicated by providing a first leak hole at the first piston to communicate the rear surface space of the first piston and the hollow inside of the first piston as well as by providing a second leak hole at the second piston to communicate the rear surface space of the second piston and the hollow inside of the second piston.

Use of this structure may prevent irreversible compression loss with the simple structure.

Now, a linear compressor according to a sixth aspect of the invention includes first and second cylinders provided within a housing on both sides, first and second pistons fit within the first and second cylinders, capable of moving back and forth and defining compression chambers within the first and second cylinders, respectively, a piston shaft having end portions fixed to the first and second pistons, a linear motor in which a cylindrical mobile body having a bottom integrally fixed to the piston shaft is provided in a gap formed at a part of a magnetic circuit formed of a magnet and a magnetic frame and which drives the piston to move back and forth by supplying ac current at a prescribed frequency to an electromagnetic coil wound around the outer circumference of the mobile body, and coil springs provided having the mobile body therebetween for elastically supporting the first and second pistons within the first and second cylinders, respectively so that they can move back and forth, the first piston, piston shaft and second piston are made hollow inside and communicated with each other, compressed gas from the compression chamber within the first cylinder is supplied externally through the hollow portions of the first piston and piston shaft, while compressed gas from the compression chamber within the second cylinder is externally supplied through the hollow portions of the second piston and piston shaft.

Use of this structure permits the coil springs to be provided on both sides through the mobile body, the stroke central positions of the first and second pistons to be more easily stably controlled, and therefore a prescribed spring constant may be established.

Noises such as vibrating sound due to gas pulsation generated at the time of letting out compressed gas may be shielded within the housing, and therefore there is no necessity to additionally provide an outlet muffler for preventing the noises.

More specifically, first and second outlet valves for letting out compressed gas onto the hollow portions of the first and second pistons are provided at the first and second pistons, and compressed gas from the compression chambers are externally supplied through the hollow portions of the first and second pistons, the hollow portion of the piston shaft, the hollow mobile space portion formed within the mobile body and a communication tube capable of extending/contracting which is provided between an end side of the mobile body space portion and the main body housing. The communication tube is formed of a bellows type tube or a coil type tube.

Use of this structure permits noises to be shielded within the housing by a simple structure and the entire device to be made more compact.

Now, a linear compressor according to a seventh aspect of the invention includes first and second cylinders provided at both sides within a housing, first and second pistons fit within the first and second cylinders, capable of moving back and forth therewithin and defining compression chambers within the first and second cylinders, respectively, a piston shaft having end portions fixed to the first and second pistons, a linear motor in which a cylindrical mobile body having a bottom integrally fixed at the piston shaft is provided in a gap formed at a part of a magnetic circuit formed of a magnet and a magnetic frame and which drives the piston to move back and forth by supplying ac current at a prescribed frequency to an electromagnetic coil wound around the outer circumference of the mobile body, plate shaped piston springs provided between the housing and the piston shaft for elastically supporting the first and second pistons within the first and second cylinders, respectively so that they can move back and forth therewithin, and a gas bearing portion to let a part of compressed gas from the compression chambers within the first and second cylinders to be ejected to restrict the positions of the first and second pistons in the axial directions.

By using this structure, as the first and second pistons are positioned near the neutral points, the axial positions of the first and second pistons are restricted by the plate shaped piston springs, while as the first and second pistons are positioned near the upper and lower supporting points, the axial positions of the first and second pistons are restricted by the gas bearing portion. Therefore, the stroke central positions of the first and second piston may be controlled stably by a simple structure, abrasion at the piston portion may be prevented by limiting the deviation of the axes of the pistons when the first and second pistons are driven to move back and forth, so that the life of the device may be prolonged.

More specifically, there are provided a first communication path for supplying compressed gas from the compression chamber in the first cylinder to the gas bearing portion, and a second communication path for supplying compressed gas from the compression chamber within the second cylinder to the gas bearing portion.

Use of this structure permits gas to be supplied to the gas bearing portion using a part of compressed gas from the compression chamber, therefore there is no necessary for providing additional means for supplying gas, and the entire device may be made more compact.

More preferably, the first communication path is formed in the first piston and piston shaft, and the second communication path is formed in the second piston and piston shaft.

Use of this structure permits gas to be blown toward the side of the bearing from the piston shaft side, and therefore the entire structure may be more simplified than otherwise.

The gas bearing portion may be formed of a first gas bearing portion provided at the first cylinder on the rear side of the first piston for restricting the axial position of the first piston and a second gas bearing portion provided at the second cylinder on the rear side of the second piston for restricting the axial position of the second piston.

By using this structure, the first gas bearing limits the deviation of the axis when the first piston is positioned near the upper and lower supporting points, while the second gas bearing portion limits the deviation of the axis when the second piston is positioned near the upper and lower supporting points.

Furthermore, the first and second pistons may be freely fit capable of moving back and forth with a fine gap left within the first and second cylinders, more specifically, a fine gap set to be not more than 10 $\mu$m.

By using this structure, gas seal is formed between the cylinders and the pistons in association with the reciprocating movement of the pistons, and it is not necessary to additionally provide a gas shield member at the circumferential side surface of the pistons.

As a result, clearance seal without local bias may be implemented between the pistons and the cylinders, and degradation in the operation efficiency due to friction loss between the pistons and the cylinders as the pistons move back and forth may be prevented.

A linear compressor according to an eighth aspect of the invention includes a shaft having a piston, a cylinder having a compression chamber to accommodate the piston, a casing provided integrally with the cylinder for accommodating the shaft, a linear motor coupled with the shaft and the casing for providing the piston with reciprocating movement in order to generate the compressed gas in the compression chamber, a first elastic member coupled with the shaft for returning the piston departed from the neutral point to the neutral point, a second elastic member coupled to the shaft for preventing the deviation of the axis of the shaft.

More preferably, a vibrating portion including the piston, shaft, first elastic member, second elastic member and compressed gas has a prescribed resonant frequency, and the linear motor drives the shaft to move back and forth at the resonant frequency.

More preferably, the linear motor includes a coil provided on the casing, and a permanent magnet provided on the shaft and the first elastic member is provided to be accommodated within an inner space provided at the permanent magnet.

More preferably, the first elastic member is a coil spring, and the second elastic member is a suspension spring.

As in the foregoing, in the linear compressor according to the eighth aspect, the first elastic member for returning the piston to the neutral point, and the second elastic member for preventing the deviation of the axis of the shaft are used.

As a result, in an application to a magnet mobile type linear compressor, for example, the deviation of the axis of the piston is prevented by the second elastic member, and compression of refrigerant gas may be efficiently performed.

Furthermore, in an application to a magnet mobile type linear compressor, by accommodating the first elastic member within the inner space provided at the permanent magnet provided at the shaft, the inner space within the linear compressor may be efficiently used, so that the linear compressor may be made more compact.

BEST MODE FOR IMPLEMENTING THE INVENTION

Hereinafter, embodiments of a linear compressor according to the invention will be described in conjunction with the accompanying drawings.

Figure 26:
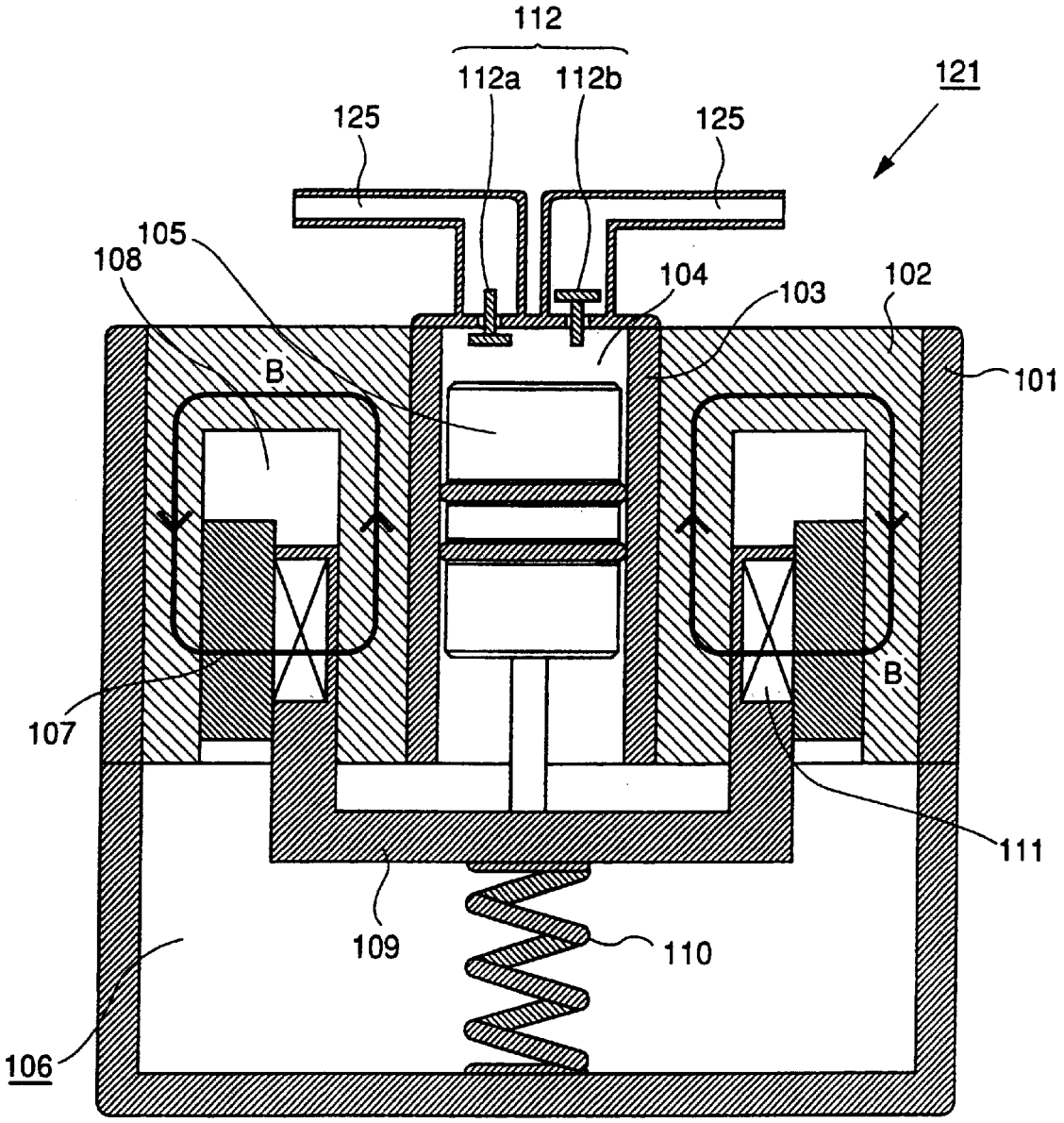
FIG.26 PRIOR ART
FIG. 26 is a cross sectional view of a conventional linear compressor.
Figure 27:
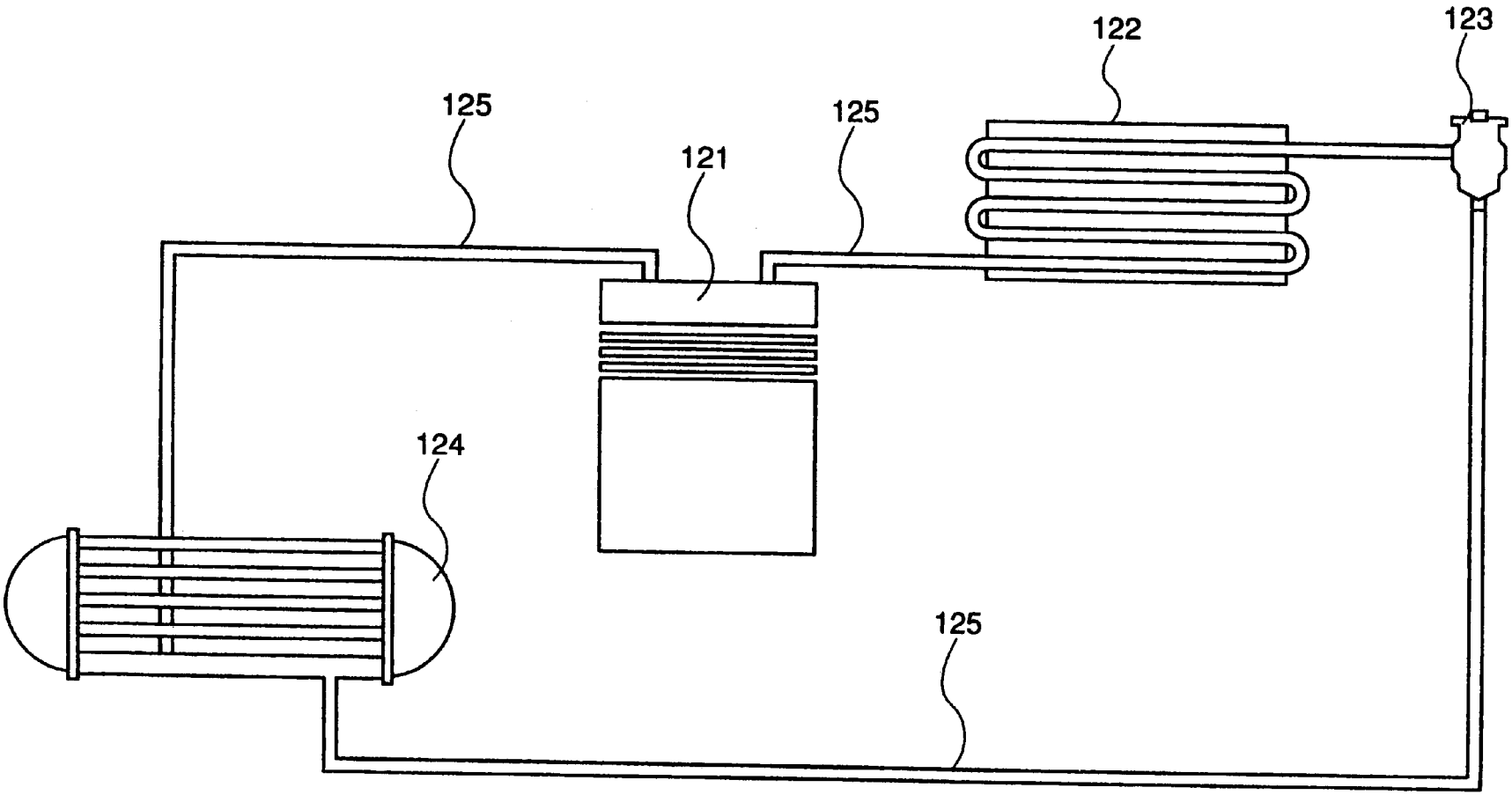
FIG.27 PRIOR ART
FIG. 27 is a conceptional diagram showing the structure of a closed type refrigerating system.

Note that the same portions as those of the structure of the conventional linear compressor described by referring to FIG. 26 are denoted with the same reference characters, and a detailed description of these portions will not be provided here.

First Embodiment

Before describing the structure of a linear compressor according to the first embodiment, the principles of the linear compressor according to this embodiment will be described.

A linear compressor model is represented by the following expression wherein an electronic model and a mechanical model are coupled by a thrust constant A.

$$E=A\cdot dx/dt+(L\cdot dI/dt+R\cdot I) \quad (1)$$

$$A\cdot I=m\cdot d^2x/dt^2+c\cdot dx/dt+k\cdot x+F+S\ (Pw-Pb) \quad (2)$$

wherein E is driving voltage, A a thrust constant (generation constant), I driving current, L coil inductance, R coil resistance, m the weight of the mobile portion, c a viscous damping coefficient (machine, gas), k a mechanical spring constant, F solid friction damping force, S a piston sectional area, Pw a piston front side pressure, Pb a piston back side pressure, and x a piston position.

Herein, solid friction damping force F and viscous damping force c·dx/dt is sufficiently smaller than the other forces, and therefore expression (2) may be defined into the following expression:

$$A\cdot I=m\cdot d^2x/dt^2+k\cdot x+S\ (Pw-Pb) \quad (2')$$

Expression (2') indicates that "motor thrust A·I is determined by the sum of inertial force $m\cdot d^2x/dt^2$, regaining force k·x and force S (Pw−Pb) related to gas compressions".

Piston front side pressure Pw refers to pressure inside the cylinder, and piston back side pressure Pb refers to pressure inside the compressor (pressure to suck in the case of a linear compressor). In the step of compressing gas, in other words, compression/letting out/re-expansion/letting in, piston back side pressure Pb is almost constant, while piston front side pressure Pw non-linearly changes, and therefore force S (Pw−Pb) related to the gas compression is non-linear. The non-linearity leads to the non-linearity of motor thrust A·I (the distortion of driving current I).

Therefore, in order to increase the efficiency of the linear compressor, the following conditions are necessary.

(i) To reduce force S (Pw−Pb) related to gas compression in order to reduce motor thrust A·I.

(ii) To reduce the non-linear component of force S (Pw−Pb) related to gas compression, in order to reduce the non-linear component of motor thrust A·I.

Stated differently, it is to reduce motor thrust A·I, the sum of sinusoidal inertia force $m\cdot d^2x/dt^2$, regaining force k·x (phases are 180° shifted from each other) and force S (Pw−Pb) related to non-linear gas compression and make the thrust into a sinusoidal shape.

Figure 1:
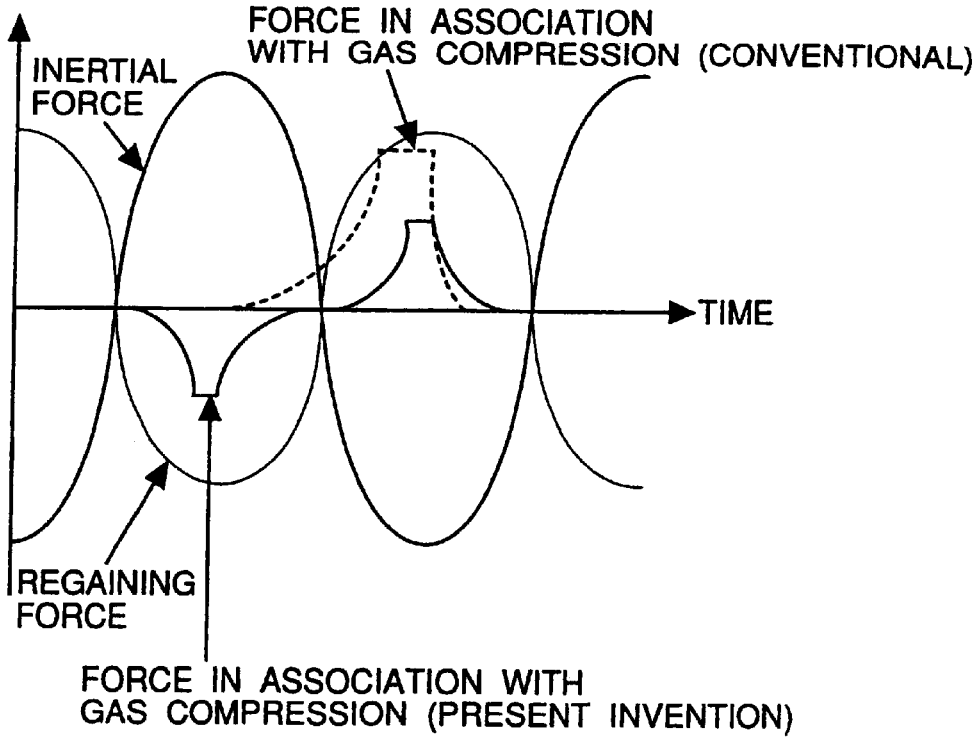
FIG. 1 is a waveform chart for use in illustration of the principles of a linear compressor according to a first embodiment of the invention.

Hence, by providing pistons at both ends of a single shaft to perform the step of compressing gas twice and alternately during one reciprocating movement of the shaft, force S (Pw−Pb) related to gas compression can be divided into two/reversed in phase as shown in FIG. 1, and motor thrust A·I may be reduced and formed to have a sinusoidal waveform.

Since motor thrust A·I is the sum of inertia force $m\cdot d^2x/dt^2$, regaining force k·x and force S (Pw−Pb) related to gas compression, and regaining force k·x and force S (Pw−Pb) related to gas compression are in phase, the smaller the ratio of force S (Pw−Pb) related to gas compression to regaining force k·x, the better the linearity of motor thrust A·I will be.

However, the area formed between the curve representing force S (Pw−Pb) related to gas compression and the time base represents the ability of cooling, which cannot be reduced, while regaining force k·x, in other words mechanical spring constant k can be increased only to a limited level. Preferably, regaining force k·x is set to a value larger than force S (Pw−Pb) related to gas compression.

Since the neutral point of the piston is maintained at a fixed position despite the load varies due to the structure of the device, the stroke of the piston may be readily controlled simply by limiting driving current I.

The invention will be now described in detail in conjunction with the accompanying drawings.

Figure 2:
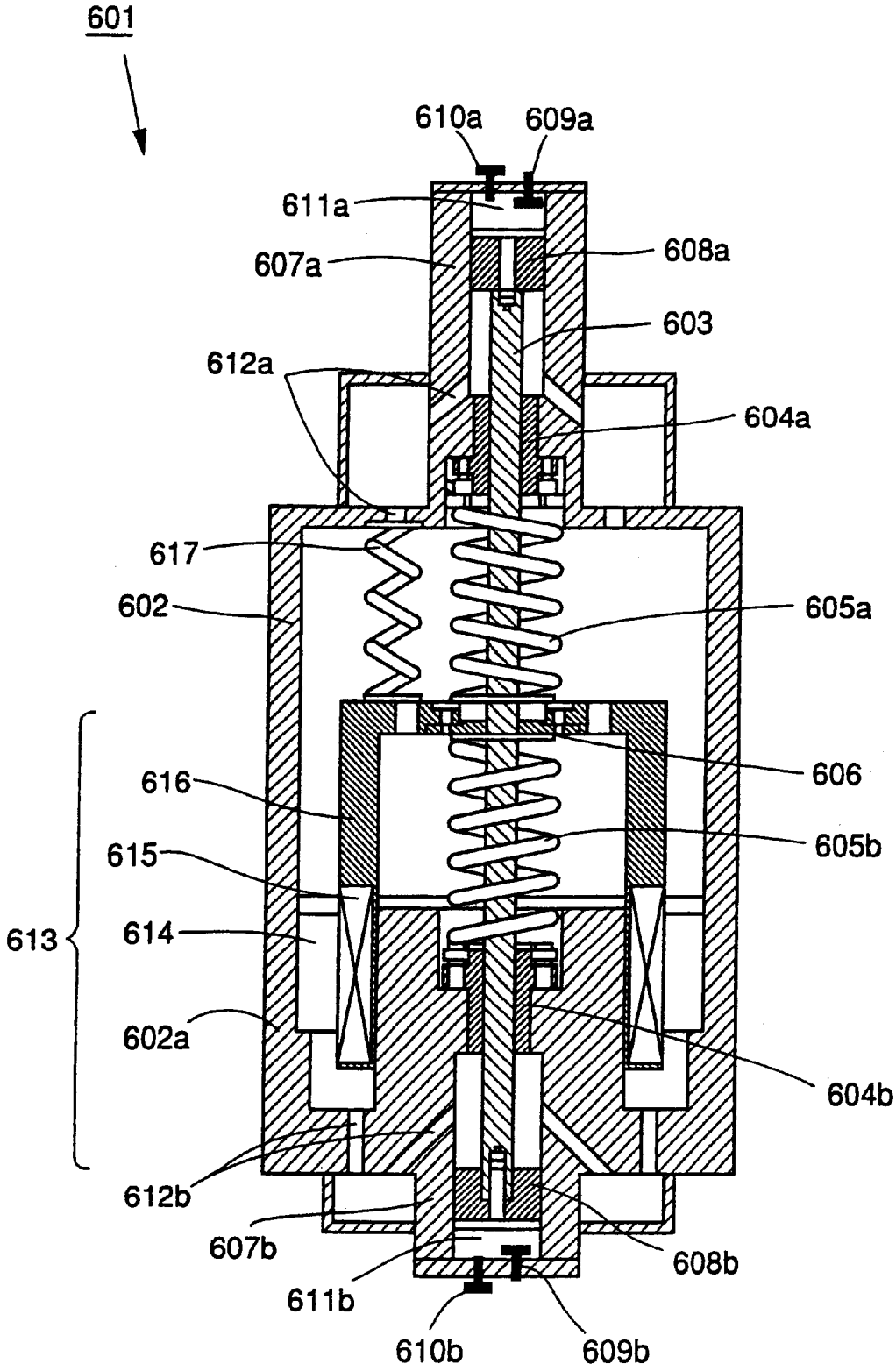
FIG. 2 is a cross sectional view showing the structure of the linear compressor according to the first embodiment of the invention.

FIG. 2 is a cross section of the structure of a linear compressor 601, to which the above-described principles are applied. Referring to FIG. 2, linear compressor 601 includes a cylindrical casing 602, a single shaft 603, two linear ball bearings 604*a* and 604*b*, two coil springs 605*a* and 605*b* and a locking device 606. Linear ball bearings 604*a* and 604*b* are provided coaxially with casing 602 at the upper and lower parts of casing 602, respectively. Shaft 603 is inserted sequentially to linear ball bearing 604*a*, coil spring 605*a*, locking device 606, coil spring 605*b* and to linear ball bearing 604*b*. Locking device 606 is fixed in the center of shaft 603, which is supported being capable of moving up and down.

Linear compressor 601 includes two pairs of cylinders 607*a* and 607*b*, pistons 608*a* and 608*b*, inlet valves 609*a* and 609*b* and outlet valves 610*a* and 610*b*. Cylinders 607*a* and

607*b* are provided coaxially with shaft 603 at the upper and lower parts of casing 602, respectively. Pistons 608*a* and 608*b* are provided on one and the other ends of shaft 603, respectively and fit into cylinders 607*a* and 607*b*. The heads of pistons 608*a* and 608*b* and the inner walls of cylinders 607*a* and 607*b* form compression chambers 611*a* and 611*b*, respectively. Valves 609*a*, 610*a*, 609*b* and 610*b* open/close depending upon gas pressure within compression chambers 611*a* and 611*b*. The rear sides of the heads of pistons 608*a* and 608*b* and the inner walls of cylinders 607*a* and 607*b* form the space in which gas leak holes 612*a* and 612*b* for preventing irreversible compression losses are formed. As shaft 603 moves up and down, compressed gas is alternately formed within the upper and lower compression chambers 611*a* and 611*b*.

Linear compressor 601 further includes a linear motor 613 for moving up and down shaft 603 and pistons 608*a* and 608*b*. Linear motor 613 is a highly controllable voice coil motor and includes a fixed portion including a yoke portion 602*a* and a permanent magnet 614, and a mobile portion including a coil 615 and a cylindrical supporting member 616. Yoke portion 602*a* forms a part of casing 602. Permanent magnet 614 is provided at the inner circumferential wall of yoke portion 602*a*. One end of supporting member 616 is inserted and capable of moving up and down between permanent magnet 614 and the outer circumferential wall of cylinder 607*b*, and the other end is fixed in the center of shaft 603 through locking device 606. Coil 615 is provided opposite to permanent magnet 614 at the one end of supporting member 616. Coil 615 is connected with the power supply through a coil spring shape electric wire 617.

Linear compressor 601 has a resonant frequency which is determined by the weights of shaft 603, locking device 606, pistons 608*a* and 608*b*, coil 615 and supporting member 616, the spring constants of gas within compression chambers 611*a* and 611*b*, and the spring constants of coil springs 605*a* and 605*b*. Driving linear motor 613 at the resonant frequency permits compressed gas to be highly efficiently generated in the two upper and lower compression chambers 611*a* and 611*b*.

Now, a method of increasing the efficiency of two-piston type linear compressor 601 in terms of control will be described. Motor input (efficient electricity) Pi and motor output Po are defined in the following expressions:

$$Pi=E\cdot I\cdot\cos\theta \tag{3}$$

$$Po=A\cdot I\cdot dx/dt\cdot\cos\phi \tag{4}$$

wherein θ is the phase difference between driving voltage E and driving current I, and φ is the phase difference between driving current I and piston speed dx/dt.

Herein, in order to reduce input electricity while maintaining the refrigerating ability, motor input Pi should be reduced while maintaining motor output Po.

More specifically, (i) To reduce the phase difference φ between driving current I and piston speed dx/dt and to reduce driving current I while maintaining motor output Po.

(ii) To increase power factor cos θ in order to reduce driving voltage E or driving current I, are necessary in view of control.

Meanwhile, it was confirmed by experiments that the phases of driving voltage E and piston speed dx/dt were almost in coincidence at a coil inductance of about 10 mh.

Therefore, the phases of driving current I and piston speed dx/dt are controlled, and their phase difference φ is set to zero, in order to improve power factors cos θ and cos φ, and to reduce motor input Pi so that the resonant state can be maintained.

Figure 3:
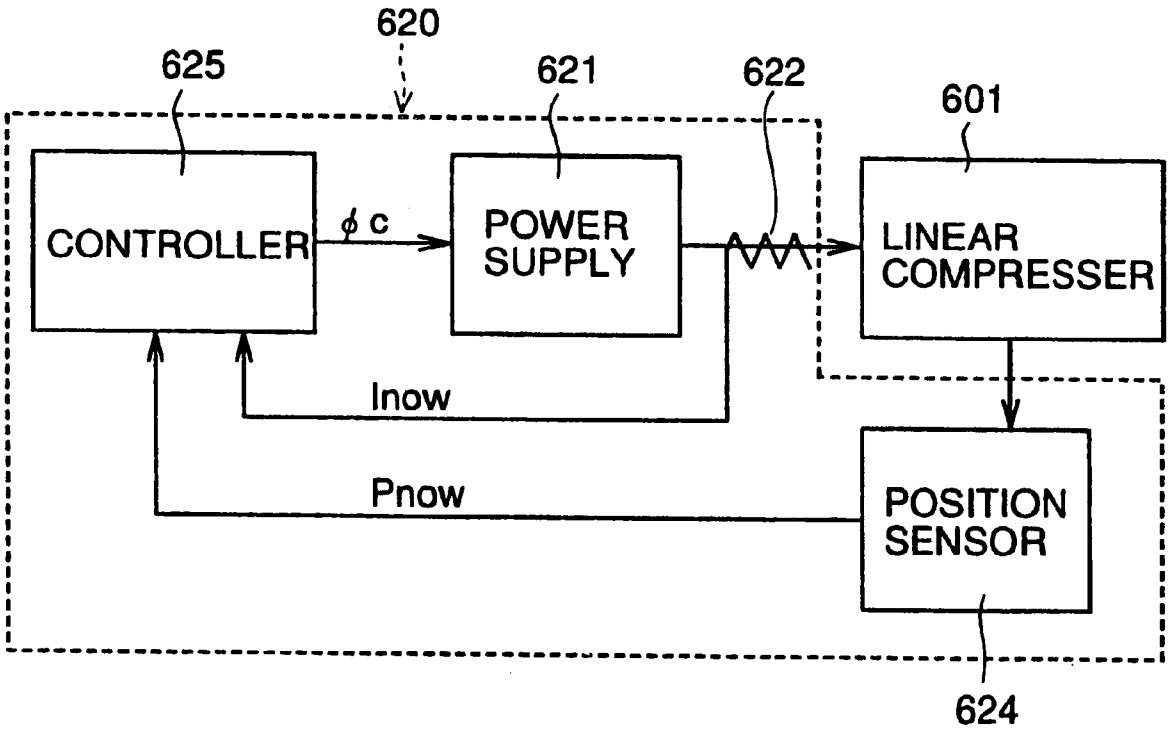
FIG. 3 is a block diagram showing the configuration of a driving device for the linear compressor shown in FIG. 2.

FIG. 3 is a block diagram showing the configuration of driving device 620 for linear compressor 601 based on the above considerations.

Referring to FIG. 3, driving device 620 includes a power supply 621, a current sensor 622, a position sensor 624 and a controller 625. Power supply 621 supplies driving current I to the coil 615 of linear motor 613 in linear compressor 601. Current sensor 622 detects the present value Inow of the output current of power supply 621. Position sensor 624 directly or indirectly detects the present piston position value Pnow in linear compressor 621. Controller 625 outputs a control signal φc to power supply 621 based on the present current value Inow detected by current sensor 622 and the present piston position value Pnow detected by position sensor 624 to control the output current I of power supply 621.

Figure 4:
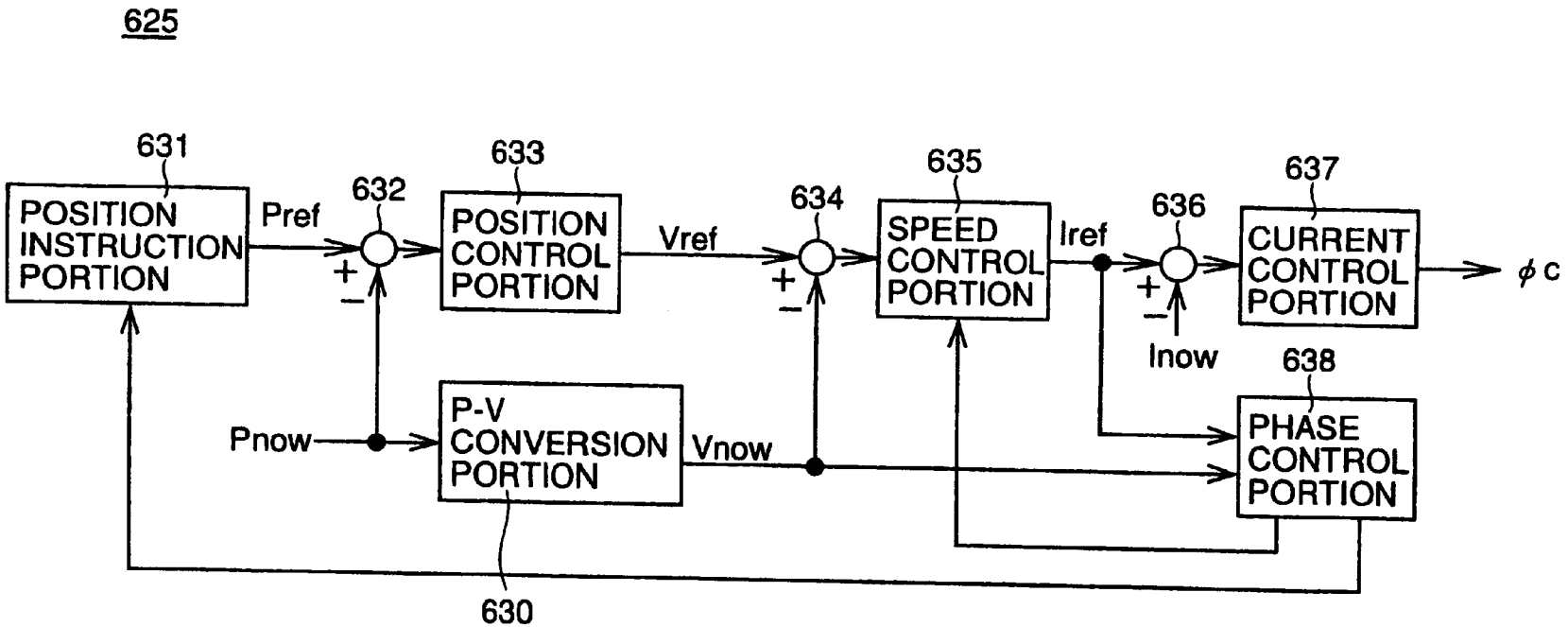
FIG. 4 is a block diagram showing the configuration of a controller 725 shown in FIG. 2.

Controller 625, as shown in FIG. 4, includes a P–V conversion portion 630, a position instruction portion 631, three subtracters 632, 634 and 636, a position control portion 633, a speed control portion 635, a current control portion 637 and a phase control portion 638. P–V conversion portion 630 differentiates the present position value Pnow detected by position sensor 624 to produce the present speed value Vnow. Position instruction portion 631 provides position instruction value Pref to subtracter 632 according to the expression Pref=B×sin ωt (wherein B is an amplitude and ω an angular frequency). In order to control the strokes of pistons 608*a* and 608*b* as described above, amplitude B is controlled. Subtracter 632 performs an operation to produce the difference Pref–Pnow between position instruction value Pref provided from position instruction portion 631 and present position value Pnow detected by position sensor 624, and provides the result of operation Pref–Pnow to position control portion 633.

Position control portion 633 performs an operation to produce speed instruction value Vref based on the expression Vref=Gv×(Pref–Pnow) (wherein Gv is a control gain), and provides the result of operation Vref to subtracter 634. Subtracter 634 performs an operation to produce the difference Vref–Vnow between speed instruction value Vref provided from position control portion 633 and the present speed value Vnow generated by P–V conversion portion 630, and provides speed control portion 635 as the result of operation Vref–Vnow.

Speed control portion 635 performs an operation to produce instruction value Iref based on the expression Iref=Gi×(Vref–Vnow) (wherein Gi is a control gain), and provides subtracter 636 with the result of operation Iref. Subtracter 636 performs an operation to produce the difference Iref–Inow between current instruction value Iref provided from speed control portion 635 and the present current value Inow detected by current sensor 622 and provides current control portion 637 with the result of operation Iref–Inow.

Current control portion 637 controls the output current I of power supply 621 by applying control signal φc to power supply 621 so that the output Iref–Inow of subtracter 636 is zero. The output current I of power. supply 621 is controlled for example according to the PWM or PAM method.

Phase control portion 638 detects the phase difference between the present speed value Vnow produced by P–V conversion portion 630 and current instruction value Iref generated by speed control portion 635, and adjusts angular frequency ω in the expression Pref=B×sin ωt and control gain Gi in the expression Iref=Gi×(Vref–Vnow) used by speed control portion 635 such that the phase difference is eliminated.

Figure 5:
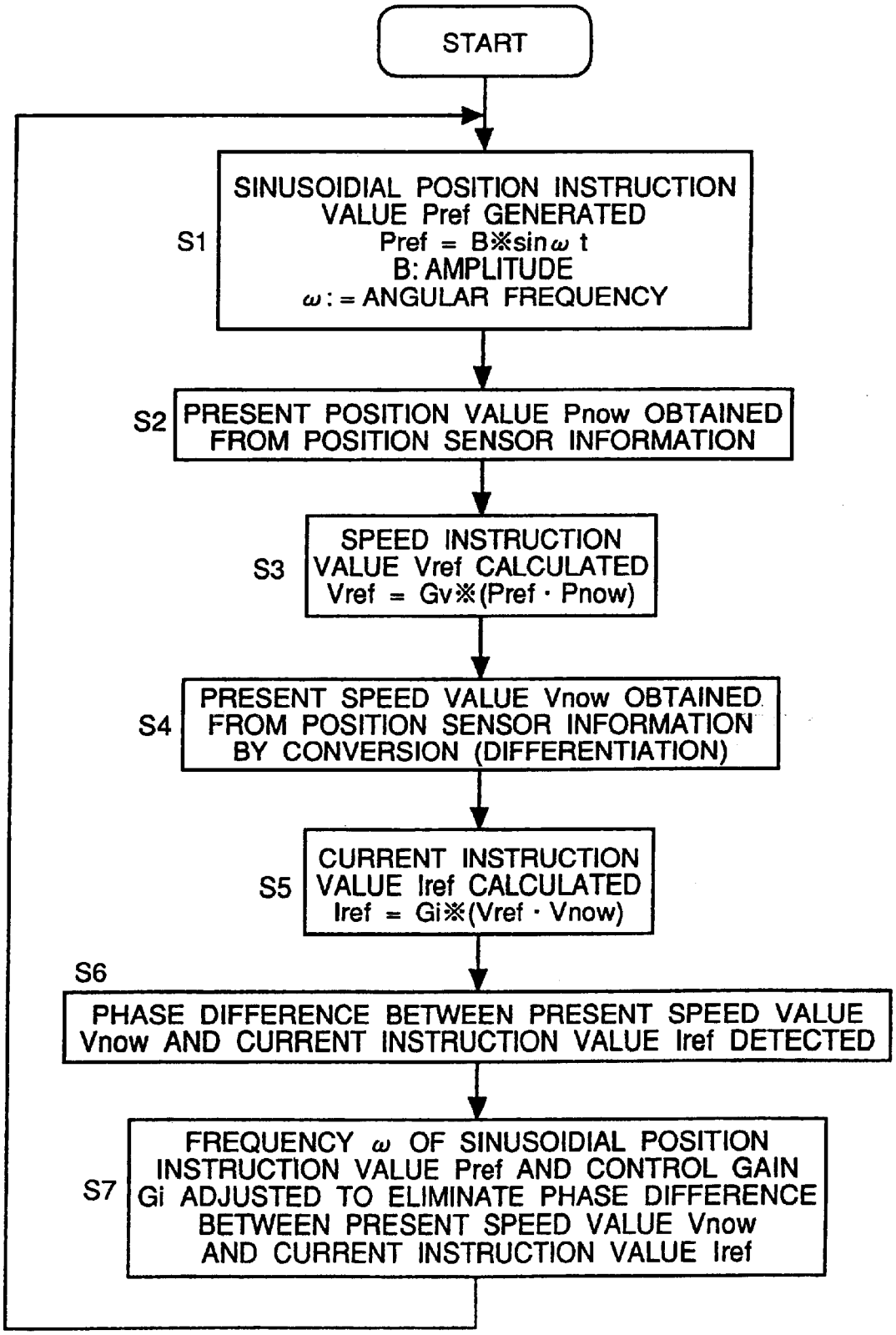
FIG. 5 is a flow chart for use in illustration of the operation of controller 725 shown in FIG. 2.

FIG. 5 is a flow chart for use in illustration of the operation of controller 625 shown in FIG. 4. According to the flow chart, the operations of linear compressor 601 and driving device 620 therefor shown in FIGS. 1 to 4 will be briefly described.

First, in step S1, position instruction value Pref is generated at position instruction portion 631, speed instruction value Vref is generated at position control portion 633, and current instruction value Iref is generated at speed control portion 635. When the coil 615 of linear rotor 613 is supplied with current, the mobile portion of linear motor 613 starts moving back and forth, which initiates generation of compressed gas.

In step S2, the present position value Pnow is detected by position sensor 624, detected present position value Pnow is provided to subtracter 632 and P–V conversion portion 630. In step S3, speed instruction value Vref=Gv×(Pref–Pnow) is operated to position control portion 633, and in step S4, present position value Pnow is converted into present speed value Vnow by P–V conversion portion 630. Speed present value Vnow is applied to subtracter 634 and phase control portion 638.

In step S5, current instruction value Iref=Gi×(Vref–Vnow) is operated by speed control portion 635, operation value Iref is applied to subtracter 636 and phase control portion 638. Current control portion 637 controls power supply 621 such that current present value Inow is in coincidence with current instruction value Iref.

In step S6, the phase difference between speed present value Vnow and current instruction value Iref is detected by phase control portion 638. In step S7, phase control portion 638 adjusts the angular frequency o of position instruction value Pref and control gain Gi so as to eliminate the phase difference between speed present value Vnow and current instruction value Iref.

Then, steps S1 to step 7 are repeated to rapidly stabilize the operation state of linear compressor 601. Furthermore, if the load varies after activation, the thrust of linear motor 613, in other words, driving current I is directly and appropriately controlled accordingly, and therefore high efficiency is achieved.

Figure 6:
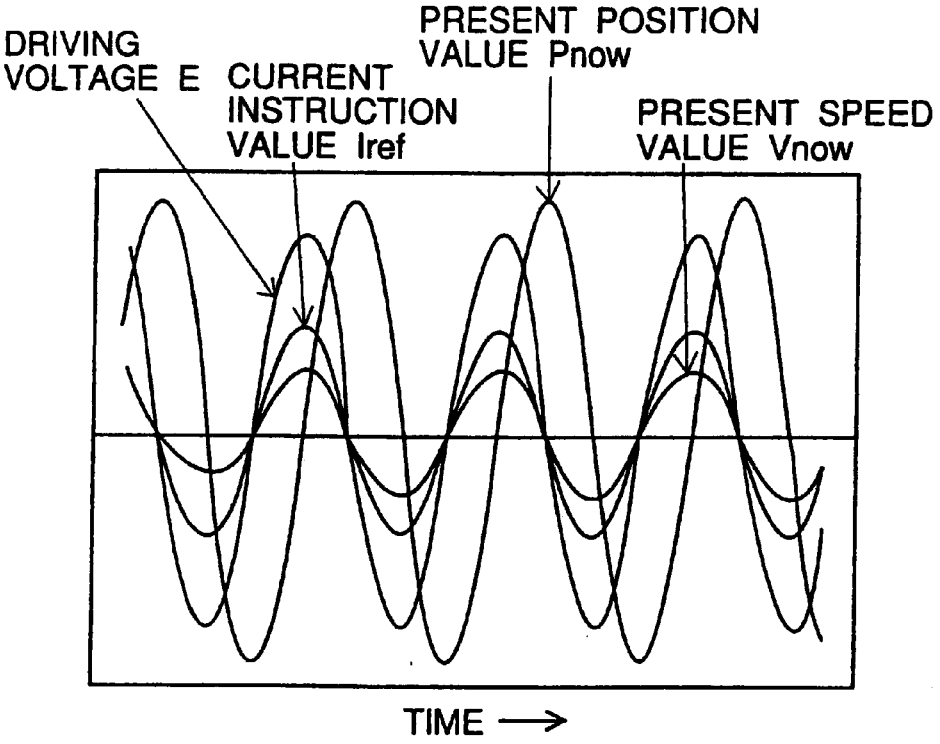
FIG. 6 is a waveform chart for use in illustration of the effects of the linear compressor and the driving device therefor shown in FIGS. 1 to 5.
Figure 7:
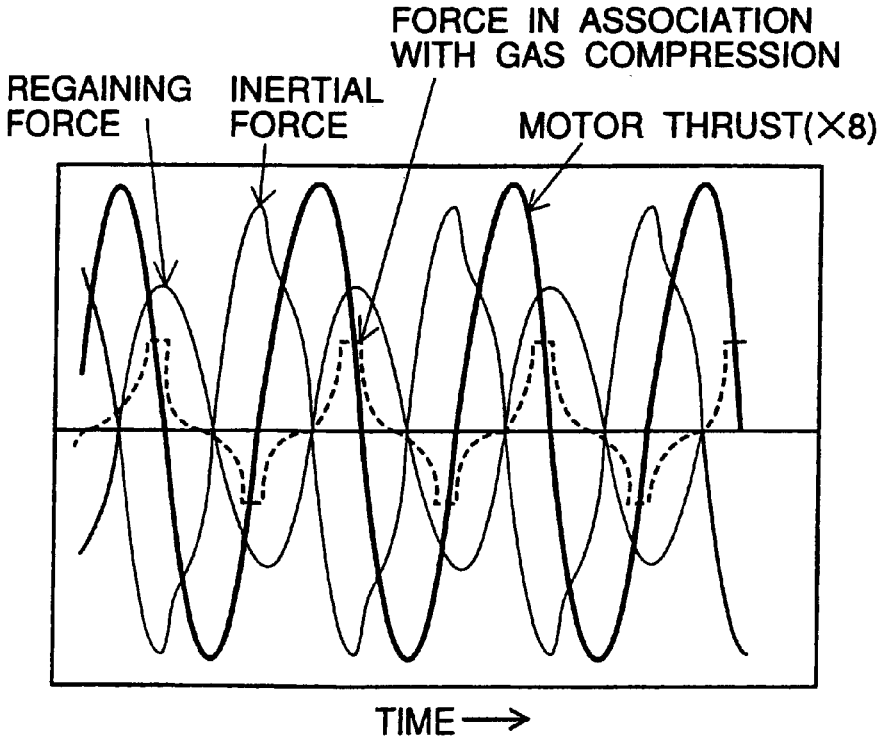
FIG. 7 is another waveform chart for use in illustration of the effects of the linear compressor and the driving device therefor shown in FIGS. 1 to 5.

FIG. 6 is a waveform chart for use in illustration of the relation between driving voltage E, current instruction value Iref, speed present value Vnow and position present value Pnow when linear compressor 601 described above is driven in a resonant state by driving device 620, while FIG. 7 is a waveform chart for use in illustration of the relation between inertia force $m \cdot d^2x/dt^2$, force S (Pw–Pb) related to gas compression and motor thrust A·Iref at the time.

Note however that the amplitude of motor thrust A·Iref is eight times the other forces in FIG. 7.

It was confirmed that in the resonant state, the phases of driving voltage E, current instruction value Iref and speed present value Vnow were in coincidence and that motor thrust A·Iref was small and had a sinusoidal waveform. The power factor at the time was 0.99 and the motor efficiency was 91.2%.

Figure 8:
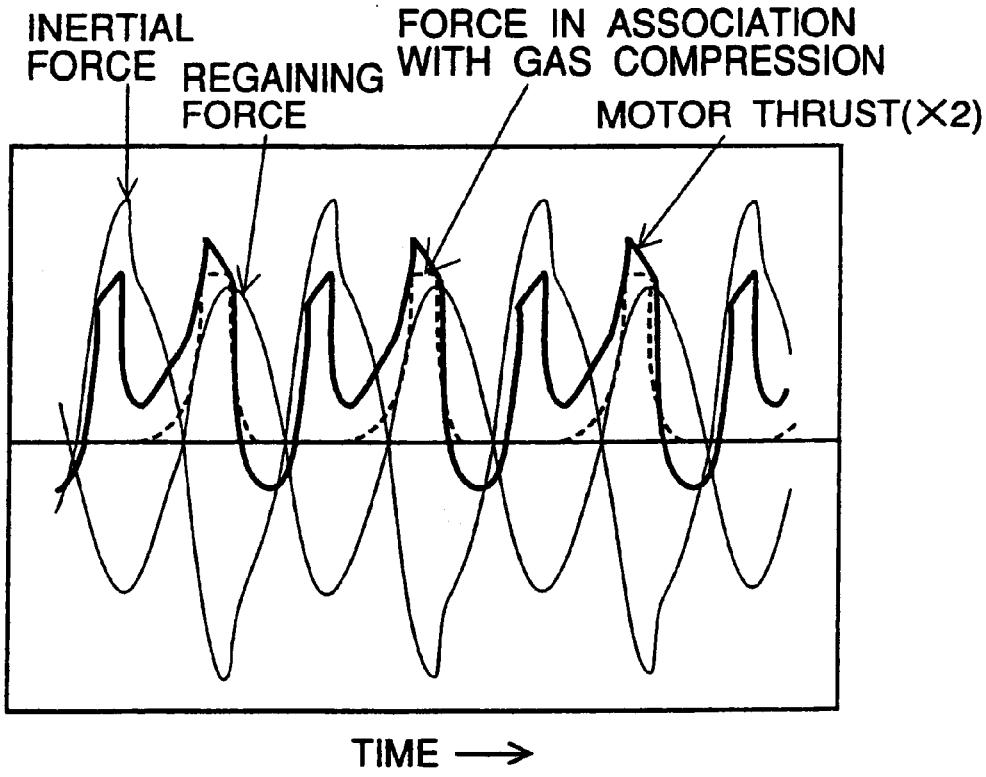
FIG. 8 is yet another waveform chart for use in illustration of the effects of the linear compressor and the driving device therefor shown in FIGS. 1 to 5.

FIG. 8 is a waveform chart for use in illustration of the relation between inertia force, regaining force, force related to gas compression and motor thrust when a conventional single piston type linear compressor is normally operated. Note however that in FIG. 8 the amplitude of the motor thrust is twice the other forces.

As compared to linear compressor 601 according to the invention in FIG. 7, the motor thrust was larger and its waveform had a great distortion.

Second Embodiment

Figure 9:
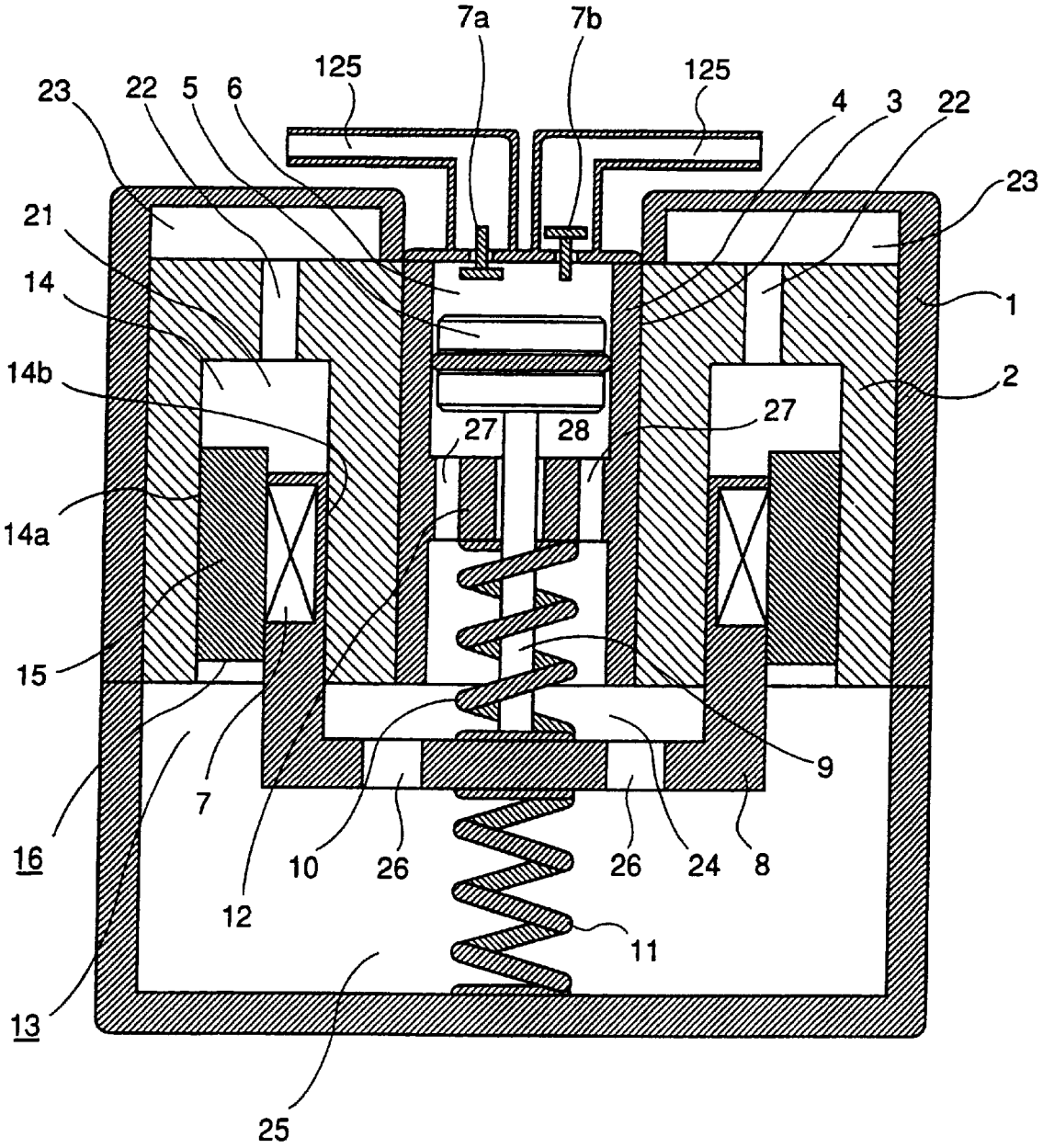
FIG. 9 is a cross sectional view of a linear compressor according to a second embodiment of the invention.

As shown in FIG. 26, the linear compressor according to this embodiment is used as a compressor for a closed type refrigerating system. The linear compressor has its outer circumference surrounded by a closed cylindrical housing 1 as shown in FIG. 9, and the linear compressor is held as a closed space. Housing 1 is a cylindrical body having a bottom, and there is formed a magnetic frame (yoke) 2 of a low carbon steel on its upper end side. A cylinder fitting hole 3 extending in the upward and downward directions is formed through the center of yoke 2, and a cylindrical cylinder 4 having a bottom formed of stainless steel is fit into cylinder fitting hole 3.

A piston 5 is slidably fit within cylinder 4, and cylinder 4 and piston 5 define a compression chamber 6 serving as a space for compressing refrigerant gas. Cylinder 4 has a valve mechanism 7 to connect with external gas flow paths 125, wherein 7*a* is an intake valve for taking in refrigerant gas evaporated by an evaporator 124 through gas flow path 125, and 7*b* is an exhaust valve to let out high pressure refrigerant gas compressed in compression chamber 6 to a condenser 122 through gas flow path 125.

For piston 5, a cylindrical mobile body (bobbin) 8 having a bottom and having its side facing piston 5 opened is integrally fixed to the piston shaft 9 of piston 5, and there are provided first and second coil springs 10 and 11 for elastically supporting bobbin 8 and piston 5 such that they can move back and forth.

First coil spring 10 is wound around piston shaft 9, and has its one end abutted against bobbin 8, and the other end abutted against a spring receiving portion 12 provided at cylinder 4. Second coil spring 11 is fixed between the central portion of the bottom of housing 1 and bobbin 8. Thus providing first and second coil springs 10 and 11 on both sides through bobbin 8, the central position of the stroke of piston 5 can be easily controlled at a fixed position, and the spring constant can be increased, so that the device may be made more compact.

Piston 5 and bobbin 8 are driven to be connected with linear motor 13 serving as a driving source to drive them to move back and forth.

An annular recess 14 concentric with cylinder fitting hole 3 is formed in yoke 2, an annular permanent magnet 15 is attached to the outer side face 14*a* of recess 14 at a prescribed space S to the inner side face 14*b*, and magnet 15 and yoke 2 form a magnetic circuit 16 for linear motor 13. Magnetic circuit 16 generates a magnetic field having a prescribed intensity in the space S between magnet 15 and the inner side face of recess 14.

Bobbin 8 is provided in space S and capable of moving back and forth therein, an electromagnetic coil 7 is wound around the outer circumferential portion of bobbin 8 at a position opposite to magnet 15, ac current at a prescribed frequency (60 Hz in this embodiment) is passed through a lead (not shown) to drive electromagnetic coil 7 and bobbin 8 by the function of a magnetic field through space S, thus piston 5 is moved back and forth within cylinder 4, and gas pressure is generated at a prescribed cycle in compression chamber 6.

Furthermore, yoke 2 is provided with a first leak hole 22 for externally leaking gas in a space portion 21 of the magnetic circuit formed by yoke 2, permanent magnet 15 and bobbin 8, and a buffer space portion 23 communicated with first leak hole, so that no compression/expansion work of gas is performed in the space portion 21 of the magnetic circuit in association with the upward and downward movement of bobbin 8. Note that eight such first leak holes 22 are provided in this embodiment.

Meanwhile, bobbins 8 is provided with a plurality of second leak holes 26 (8 holes in this embodiment) which communicate the inner space portion 24 of the bobbin surrounded by spring receiving portion 12 on the back side of piston 5 and the inner portion of bobbin 8 with a space portion 25 on the bottom side of the bobbin provided with a piston spring 11, so that no compression/expansion work of gas is performed in the inner space portion 24 of the bobbin in association with the upward and downward movement of bobbin 8. Spring receiving portion 12 is also provided with a plurality of third leak holes 27 (6 such holes in this embodiment), such that no compression/expansion work of gas is performed in the back space 28 of piston 5 in association with the upward and downward movement of piston 5.

Figure 10:
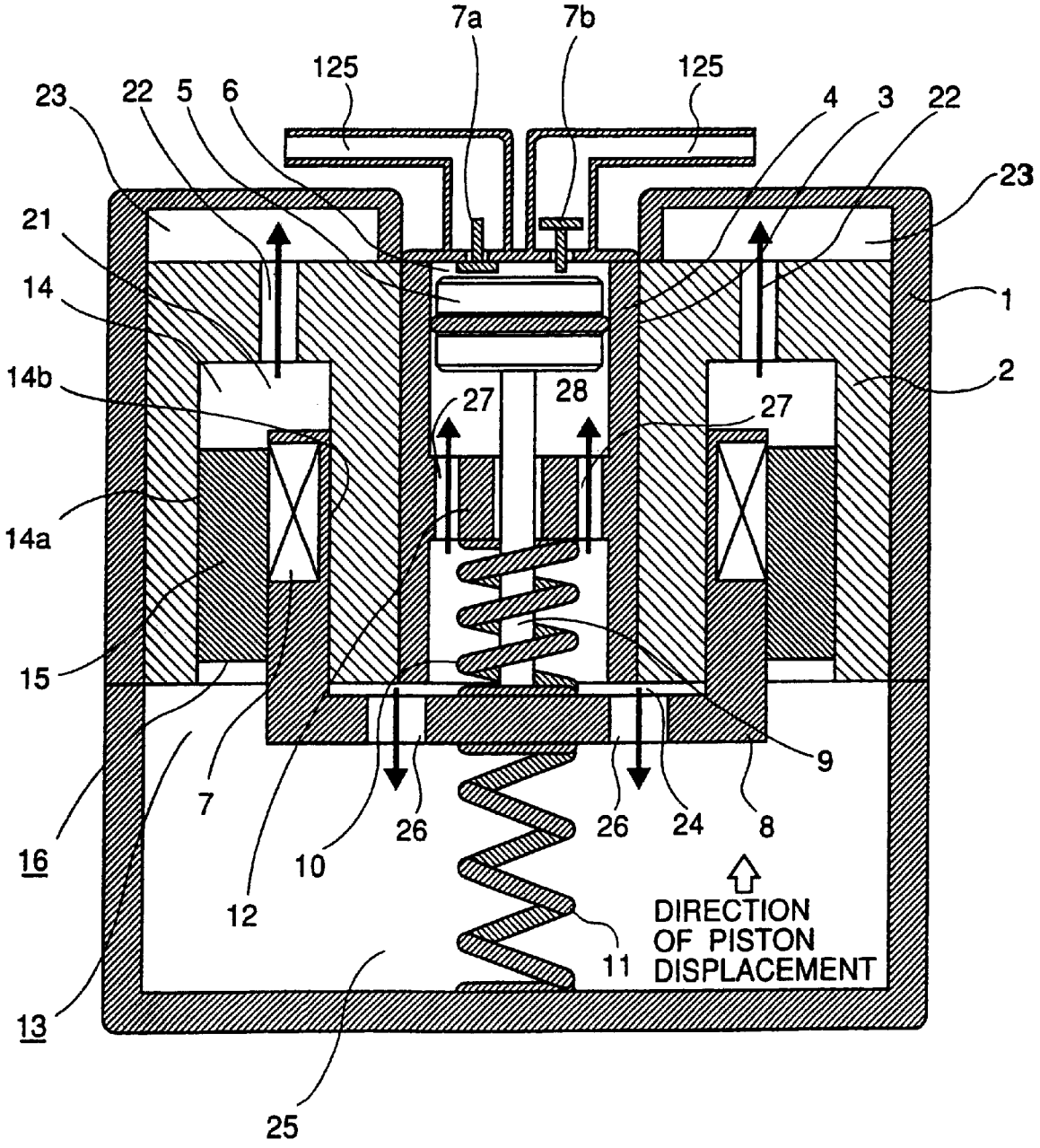
FIG. 10 is a cross sectional view showing how gas is let out from the linear compressor shown in FIG. 9.
Figure 11:
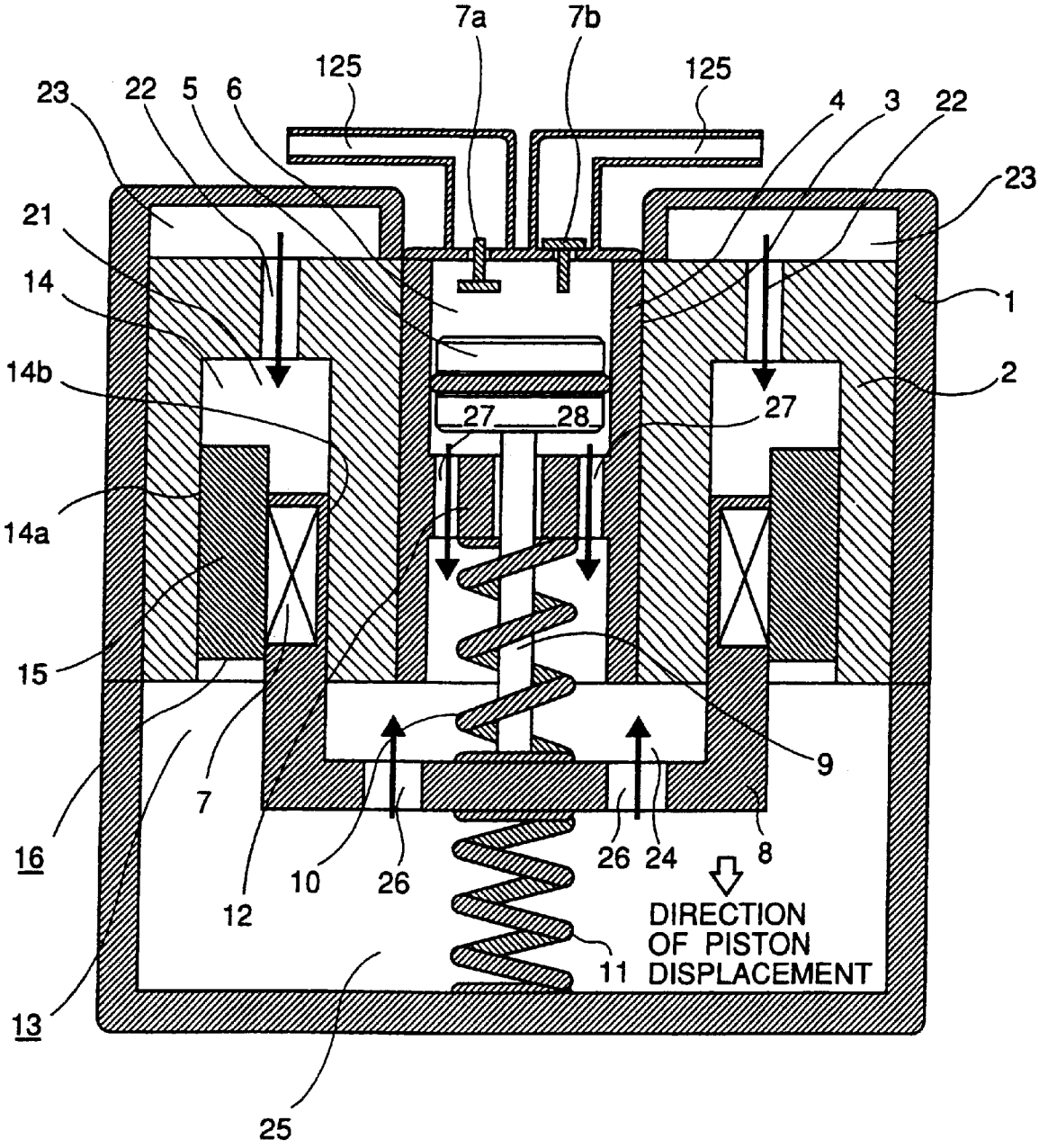
FIG. 11 is a cross sectional view showing how gas is let into the linear compressor shown in FIG. 9.

FIG. 10 is a cross sectional view showing how gas is let out from compression chamber 6, while FIG. 11 is a cross sectional view showing how gas is taken into compression chamber 6. As can be clearly seen from both FIGS. 10 and 11, gas is leaked into buffer space portion 23 and bobbin back space portion 25 so that gas in the space portion 21 of the magnetic circuit, bobbin inner space portion 24 and piston back space 28 does not perform any compression/expansion work in association with the upward and downward movement of piston 5.

Therefore, if the gap between yoke 2 and bobbin 8 and the gap between permanent magnet 15 and electromagnetic coil 7 are reduced as much as possible, gas compression/expansion work will not be performed in the space portion 21 of the magnetic circuit, bobbin inner space portion 24 and the back space 28 of piston 5, and therefore irreversible compression losses may be prevented. As a result, the efficiency of the linear compressor may be increased.

Note that in this embodiment, piston 5 and bobbin 8 are separately formed, they may be formed integrally, or permanent magnet 15 may be fixed at the inner side of yoke 2. In addition, housing 1, yoke 2 and cylinder 4 may be integrally formed. In this case, however, magnetic circuit 13 should be formed of the same material as yoke 2.

Third Embodiment

Figure 12:
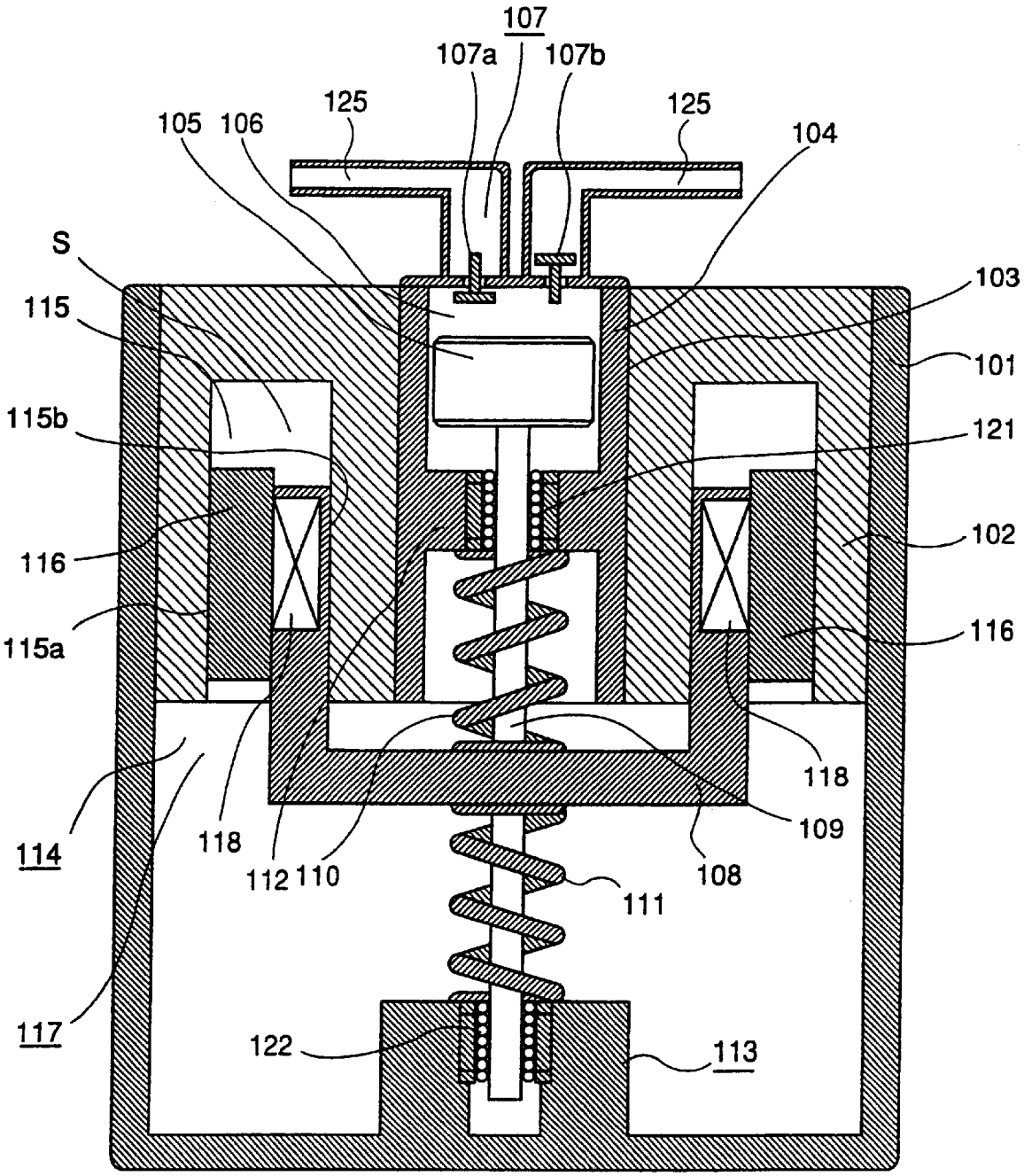
FIG. 12 is a cross sectional view of a linear compressor according to a third embodiment of the invention.

As shown in FIG. 26, a linear compressor according to this embodiment is used as a compressor for a closed type refrigerating system. The linear compressor had its outer circumference enclosed by a closed cylindrical type housing 101 as shown in FIG. 12, and is held as a closed space. Housing 101 is a cylindrical body with a bottom, and a magnetic frame (yoke) 102 of a low carbon steel is formed on its upper end side. A cylinder fitting hole 103 extending in the upward and downward directions is formed through the center of yoke 102, and a cylindrical cylinder 104 with a bottom formed of stainless steel is fit into cylinder fitting hole 103.

In cylinder 104, a piston 105 is freely inserted through a fine space and capable of moving back and forth therein, and cylinder 104 and piston 105 define a compression chamber 106 serving as a compression space for refrigerant gas. Herein, the fine space is set within the range in which gas seal is formed with cylinder 104 in association with the reciprocating movement of piston 105, more specifically the space is set to not more than 5 $\mu$m. Note that in this embodiment, the space is set to 5 $\mu$m.

A valve mechanism 107 for connecting cylinder 104 and external gas flow paths 125 is formed in cylinder 104, wherein 107*a* is an intake valve to taking in refrigerant gas evaporated by an evaporator 124 through gas flow path 125, and 107*b* is an exhaust valve to let out high pressure refrigerant gas which is compressed in compression chamber 106 to a condenser 122 through gas flow path 125.

For piston 105, a cylindrical mobile body (bobbin) 108 having a bottom formed of a light weight non-magnetic material, resin and having its side facing piston 105 opened is integrally fixed to the piston shaft 109 of piston 105, and there are provided first and second coil springs 110 and 111 for elastically supporting bobbin 108 and piston 105 so that they can move back and forth. First coil spring 110 is wound around piston shaft 109, has its one end abut against bobbin 108, and the other end abut against a first guide portion 112 provided at cylinder 104. Second coil spring 111 is fixed between a second guide portion 113 provided in the center of the bottom of housing 101 and bobbin 108.

Piston 105 and bobbin 108 are driven to be connected with linear motor 114 serving as a driving source which drives them to move back and forth.

In yoke 102, an annular recess 115 concentric with cylinder fitting hole 103 is formed, an annular permanent magnet 116 is attached to the outer side face 115*a* of recess 115 at a prescribed space S to inner side face 115*b*, and magnet 116 and yoke 102 form a magnetic circuit 117 for linear motor 114. Magnetic circuit 117 generates a magnetic field having a prescribed intensity in space S between magnet 116 and the inner side face of recess 115.

Bobbin 8 is provided in space S and capable of moving back and forth therein, an electromagnetic coil 118 is wound around the outer circumference of bobbin 108 at a position opposite to magnet 116, ac current at a prescribed frequency (60 Hz in this embodiment) is passed through a lead (not shown) to drive coil 118 and bobbin 108 by the function of a magnetic field through space S to move piston 105 back and forth within cylinder 104, so that gas pressure at a prescribed cycle is generated in compression chamber 106.

First and second guide portions 112 and 113 have rolling bearings 121 and 122, respectively at their inner circumferences, and slidably hold piston shaft 109 in the upward and downward directions. Herein, rolling bearings 121 and 122 are linear rolling bearings, and a ball spline LSAG8 manufactured by IKO corporation is used in this embodiment. However, the used linear rolling bearing is only an example, and other types of ball splines may be used or a slide push type may be used. Thus, the longitudinal motion of piston shaft 109 is supported by a rolling bearing having a friction coefficient ($\mu$=0.001 to 0.006) smaller than that of a conventional slide bearing ($\mu$=0.01 to 0.1).

As in the foregoing, by providing first and second coil springs 110 and 111 on both sides through bobbin 8, the central position of the stroke of piston 105 may be easily controlled at a fixed position, the spring constant may be increased, and the size of the device may be reduced.

Furthermore, piston shaft 9 is directly supported by rolling bearings 121 and 122, and the direction of the longitudinal motion of piston 105 is restricted, so that clearance seal may be implemented with a fine space between the piston and the cylinder. As a result, deterioration in the operation efficiency caused by friction losses at the time of the reciprocating movement of piston 105, shortening of the life of the device by friction of a gas shield member provided at piston 105 and contamination of refrigerant by abrasion dust will be prevented.

Fourth Embodiment

Figure 13:
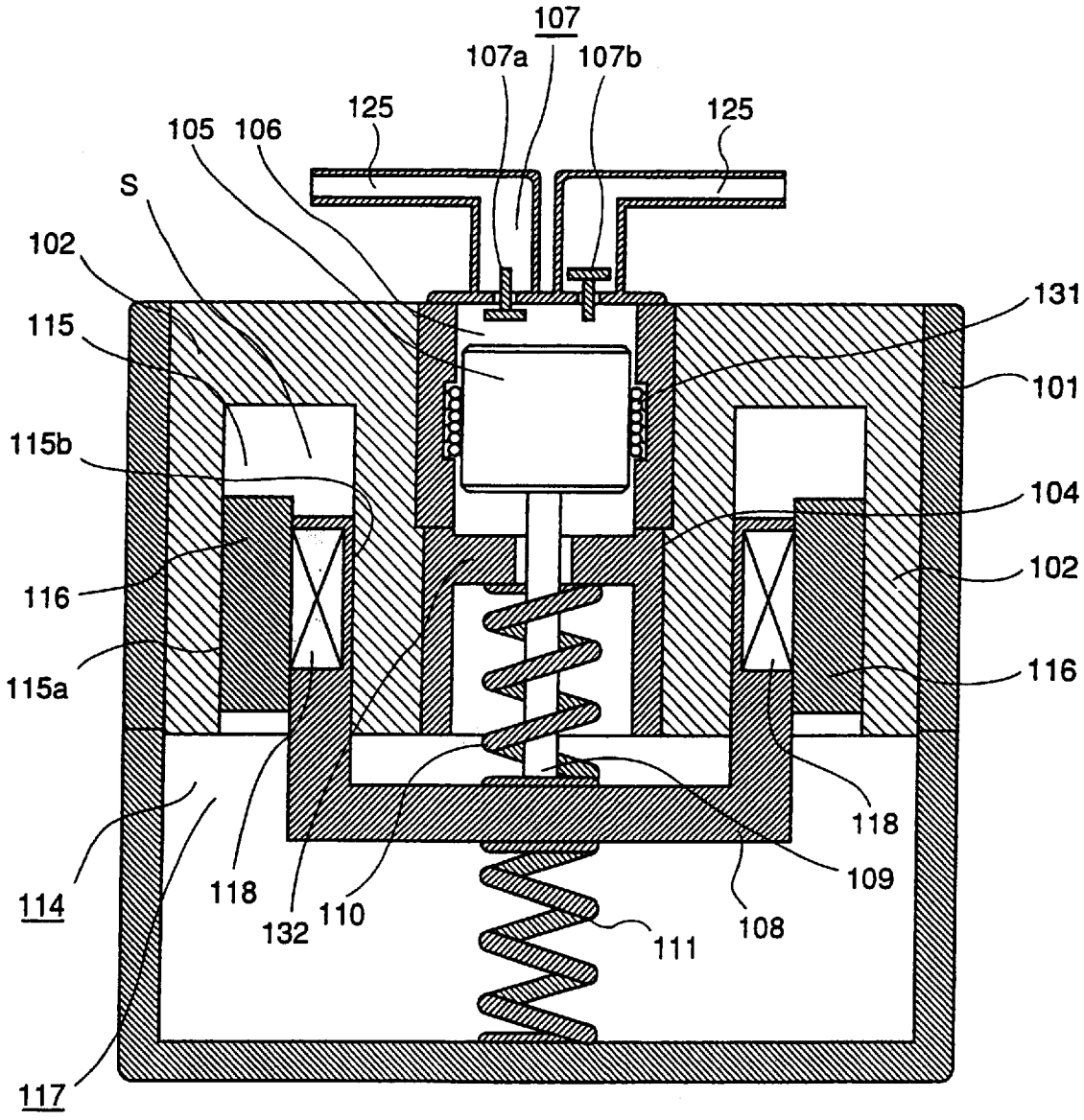
FIG. 13 is a cross sectional view of a linear compressor according to a fourth embodiment of the invention.

A linear compressor according to this embodiment will be now described by referring to FIG. 13. Herein, this embodiment is different from the third embodiment shown in FIG. 12 and described above in that in place of slidably retaining piston shaft 109 at the rolling bearings 121 and 122 of first and second guide portions 112 and 113, a rolling bearing 131 is provided at cylinder 104, and piston 105 is moved back and forth along cylinder 104 through rolling bearing 131.

A first coil spring 110 is provided between a spring receiving portion 132 and a bobbin 108 provided at cylinder 104 on the back side of piston 105, and a second coil spring Ill is provided between the central portion of the bottom of housing 101 and bobbin 108. Note that the same portions as those of the second embodiment are denoted with the same reference characters, and a detailed description thereof will not be provided here.

Herein, rolling bearing 131 is a ball spline or slide push longitudinal rolling bearing as is the case with the third embodiment shown in FIG. 12 as described above. Rolling bearing 131 used is however provided in the vicinity of the center of the stroke of piston 105 such that gas within compression chamber 106 does not leak through the rolling bearing by the reciprocating movement of piston 105.

Therefore, piston 105 may be slided along cylinder 104 through the rolling bearing rather than making piston 105 slide along cylinder 104 through the sliding bearing as has been conventionally practiced, and deterioration in the operation efficiency caused by friction losses at the time of the reciprocating movement of piston 105, shortening of the life of the device caused by friction of a gas shield member provided at piston 105 or contamination of refrigerant by abrasion dust will be prevented. Furthermore, as is the case with the second embodiment, the central position of the stroke of piston 105 may be easily controlled at fixed position, the spring constant may be increased, and the size of the device may be reduced as a result.

Furthermore, in this embodiment, rolling bearing 131 is provided at cylinder 104, but the rolling bearing may be provided at the circumference of piston 105.

Note that in the third and fourth embodiments, piston 105 and bobbin 108 are separately formed as is the case with the second embodiment, they may be formed integrally, or permanent magnet 116 may be fixed at the inner side of yoke 102. In addition, housing 101, yoke 102 and cylinder 104 may be formed integrally. In this case, however, magnetic circuit 114 should be formed of the same material as that of yoke 102.

Fifth Embodiment

Figure 14:
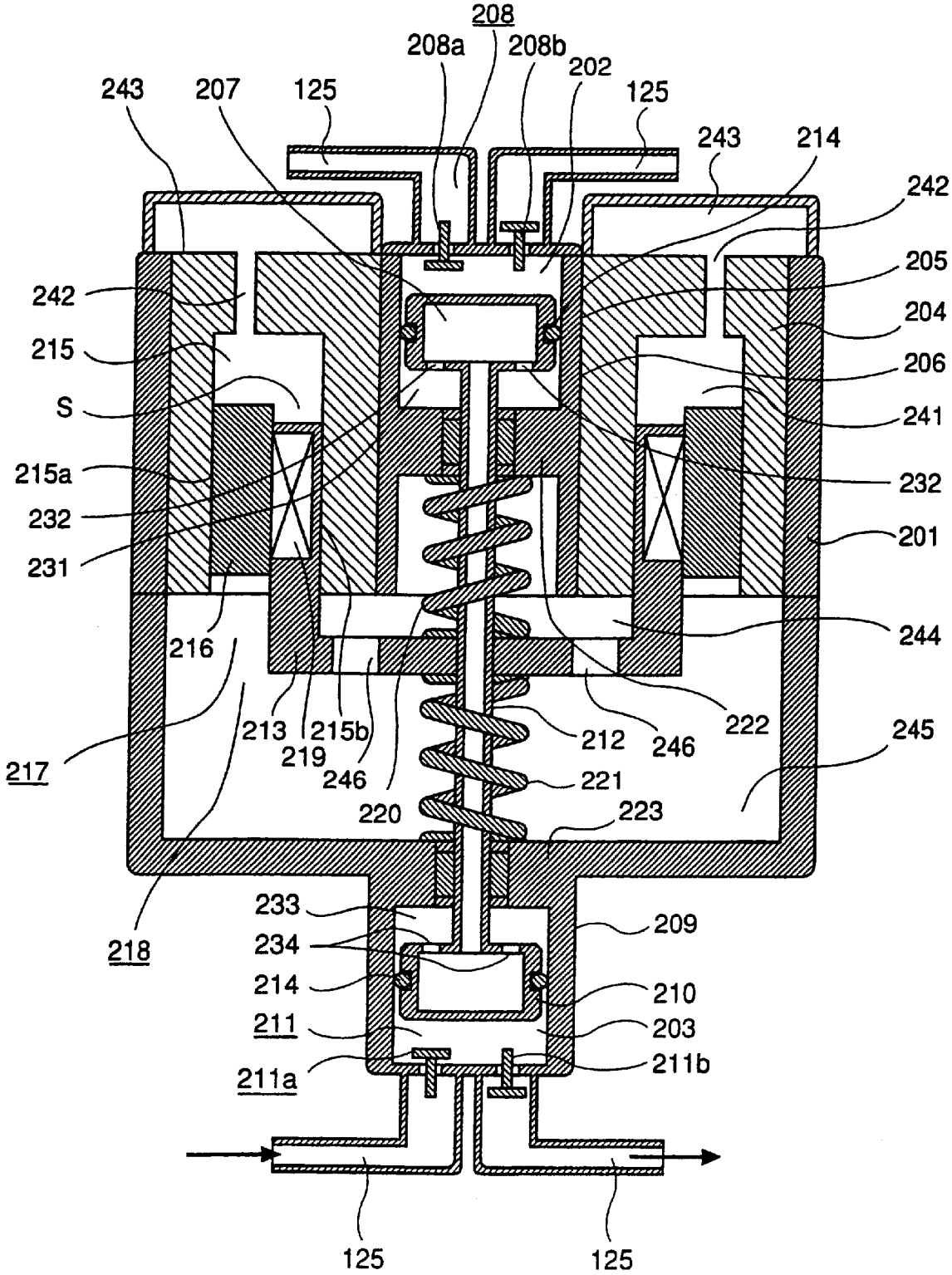
FIG. 14 is a cross sectional view of a linear compressor according to a fifth embodiment of the invention.

A linear compressor according to this embodiment is used as a compressor for a closed type refrigerating system as shown in FIG. 26. The linear compressor has its outer circumference surrounded by a closed cylindrical type housing 201 as shown in FIG. 14, and is held as a closed space. Housing 201 has compression chambers 202 and 203 at its upper and lower parts.

At the upper end portion of housing 201, a magnetic frame (yoke) 204 of a low carbon steel is formed, a cylinder fitting hole 205 extending in the upward and downward directions is formed through the center of yoke 204, and a first cylinder 206 in a cylindrical shape with a bottom of stainless steel is fit into cylinder fitting hole 205.

A first piston 207 is slidably fit into first cylinder 206, and first cylinder 206 and first piston 207 define upper compression chamber 202 serving as a space for compressing refrigerant gas. A first valve mechanism 208 for connecting first cylinder 206 and external gas flow paths 125 is formed at first cylinder 206, wherein 208*a* refers to an intake valve for taking in refrigerant gas evaporated by an evaporator 124 through gas flow path 125, and 208*b* refers to an exhaust valve for letting out high pressure refrigerant gas compressed by upper compression chamber 202 to a condenser 122 through gas flow path 125.

Meanwhile, there is provided a second cylinder 209 extending in the upward and downward directions at the lower part of housing 201 on the opposite side to first cylinder 206, a second piston 210 is slidably fit into second cylinder 209, and second cylinder 209 and second piston 210 define lower compression chamber 203 serving as a space for compressing refrigerant gas. Similarly to upper compression chamber 202, there is formed a second valve mechanism 211 to connect second cylinder 209 with external gas flow path 125 at second cylinder 209, wherein 211*a* refers to an intake valve for taking in refrigerant gas evaporated by evaporator 124 through gas flow path 125, and 211*b* refers to an exhaust valve for letting out high pressure refrigerant gas compressed by lower compression chamber 203 to condenser 122 through gas flow path 125.

First and second pistons 207 and 210 are coupled by a piston shaft 212, a cylindrical mobile body (bobbin) 213 with a bottom having its side facing first piston 207 opened is integrally fixed at the central position of piston shaft 212. Note that there is provided a gas shield member 214 such as a piston ring at the outer circumferences of first and second pistons 207 and 210.

There is formed an annular recess 215 concentric with cylinder fitting hole 205 at yoke 204, an annular permanent magnet 216 is attached to the outer side face 215*a* of recess 215 at a prescribed space S to inner side face 215*b*, magnet 216 and yoke 204 form a magnetic circuit 218 for a linear motor 217, and magnetic circuit 218 generates a magnetic field having a prescribed intensity in space S between magnet 216 and the inner side face of recess 215.

Bobbin 213 is provided in space S formed at a part of magnetic circuit 218 of magnet 216 and yoke 204, ac current at a prescribed frequency is supplied to an electromagnetic coil 219 wound around the outer circumference of bobbin 213 to move back and forth first and second pistons 207 and 210 in first and second cylinders 206 and 209, respectively, and gas pressure at a prescribed cycle is generated in upper and lower compression chambers 202 and 203.

Piston shaft 212 is provided with first and second coil springs 220 and 221 for elastically supporting first and second pistons 207 and 210 such that these pistons can move back and forth. More specifically, first coil spring 220 has piston shaft 212 inserted therethrough and is provided between a first spring receiving portion 222 provided at first cylinder 206 and bobbin 213 for pressing and urging, while second coil spring 221 has piston shaft 212 on the opposite side through bobbin 213 inserted therethrough and is provided between a second spring receiving portion 223 provided at the upper part of second cylinder 209 and bobbin 213 for pressing and urging.

In the linear compressor thus having compression chambers 202 and 203 on both sides, by providing first and second coil springs 220 and 221 on both sides through bobbin 213, the stroke central positions of first and second pistons 207 and 210 can be readily controlled at a fixed position, and a prescribed spring constant may be established.

Figure 15:
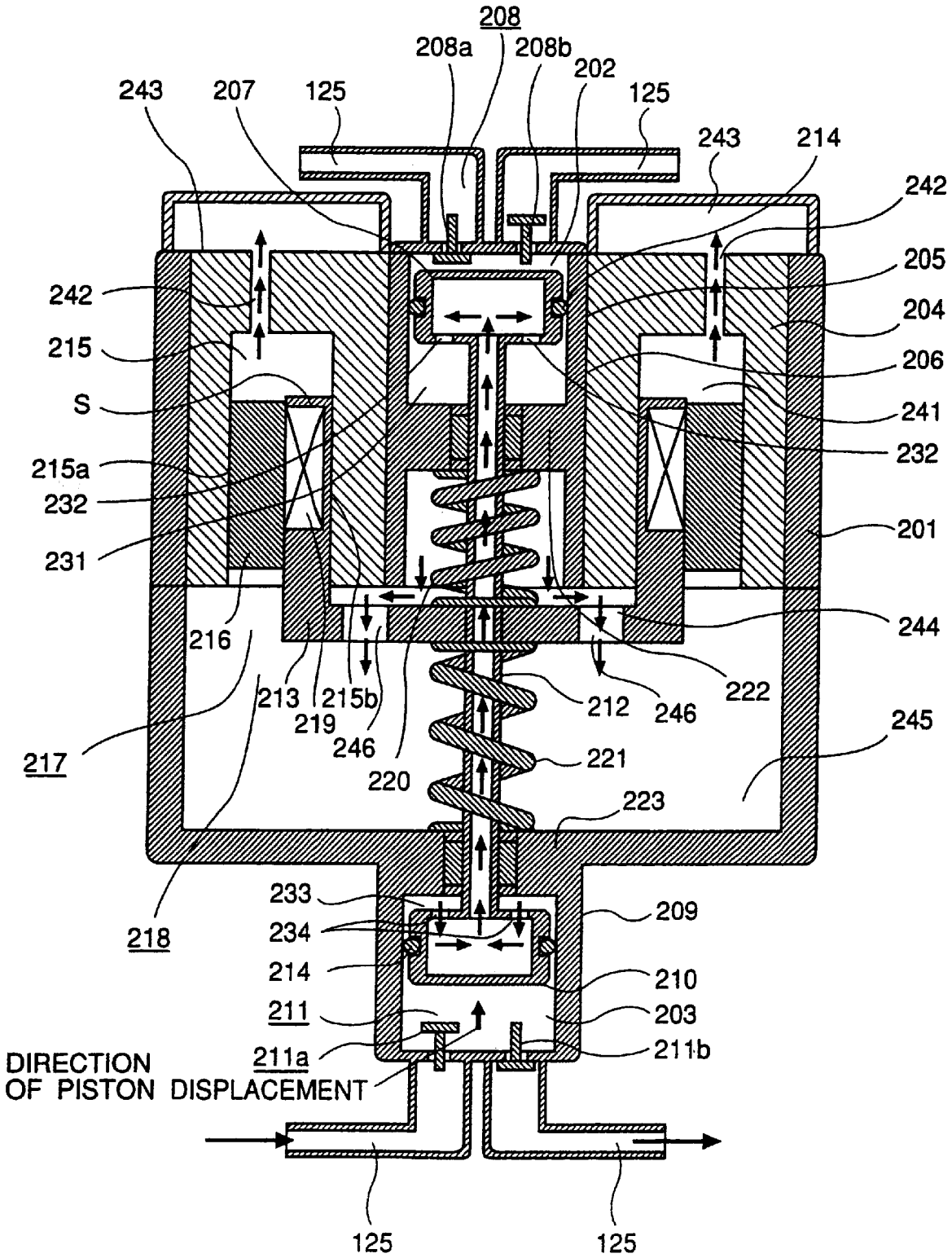
FIG. 15 is a cross sectional view for use in illustration of the operation of the linear compressor shown in FIG. 14.

Furthermore, first piston 207, second piston 210 and piston shaft 212 are hollow inside, first piston 207 is provided with a first leak hole 232 for leaking gas in its back space portion 231, and second piston 210 is provided with a second leak hole 234 for leaking gas in its back space portion 233. Therefore, as shown in FIG. 15, gas in back space portions 231 and 233 is communicated through first piston 207, piston shaft 212 and second piston 210 in association with the reciprocating movement of first and second pistons 207 and 210 as driven by linear motor 217, and therefore no compression/expansion work is performed so that there will be no irreversible compression loss. As a result, the efficiency of the linear compressor can be further improved.

Furthermore, yoke 204 is provided with a third leak hole 242 for externally leaking gas in the space portion 241 of the magnetic circuit formed by yoke 204, permanent magnet 216 and bobbin 213, and a buffer space portion 243 communicated with third leak hole 242, so that no gas compression/expansion work is performed in the space portion 241 of the magnetic circuit in association with the upward and downward movement of bobbin 213. Note that eight such third leak holes 242 are provided in this embodiment.

Meanwhile, bobbin 213 is provided with a plurality of (eight in this embodiment) fourth leak holes 246 to communicate an inner space portion 244 surrounded by first spring receiving portion 223 and the inner portion of bobbin 213 with the back space portion 245 of the bobbin at which second coil spring 221 is provided, so that no gas compression/expansion work is performed in the inner space portion 244 of the bobbin in association with the upward and downward movement of bobbin 213. Thus, if the space between yoke 204 and bobbin 213 and the space between permanent magnet 216 and electromagnetic coil 219 are reduced as much as possible, gas compression/expansion work will not be performed in the space portion 241 of the magnetic circuit and the inner space portion 244 of the bobbin, and irreversible compression losses may be prevented.

FIG. 15 is a cross sectional view showing how gas is let out from upper compression chamber 202. Herein, the arrows indicate the directions of displacement of pistons 207 and 210 and the flow of gas within the linear compressor in association with the movement of piston 207 and 210. As can be seen from the figure, in association with the upward movement of first piston 207, gas in the back space 233 is made to flow into back space 231 through second leak hole 234, second piston 210, piston shaft 212, first piston 207 and first leak hole 232, and neither compression work in back space 233 nor expansion work in back space 231 are performed at the time.

In association with the reciprocating movement of first and second pistons 207 and 210, gas in the space portion 241 of the magnetic circuit and the inner space portion 244 of the bobbin is leaked to buffer space portion 243 and the back space portion 245 of the bobbin through third and fourth leak holes 242 and 246 and therefore no compression/expansion work is performed at the time.

Note that in the above-described structure, first and second spring receiving portions 222 and 223 may be used as bearings. Such a case is more effective, because gas in the back space portions 231 and 233 of first and second pistons 207 and 210 could cause smaller irreversible compression losses.

Sixth Embodiment

Figure 16:
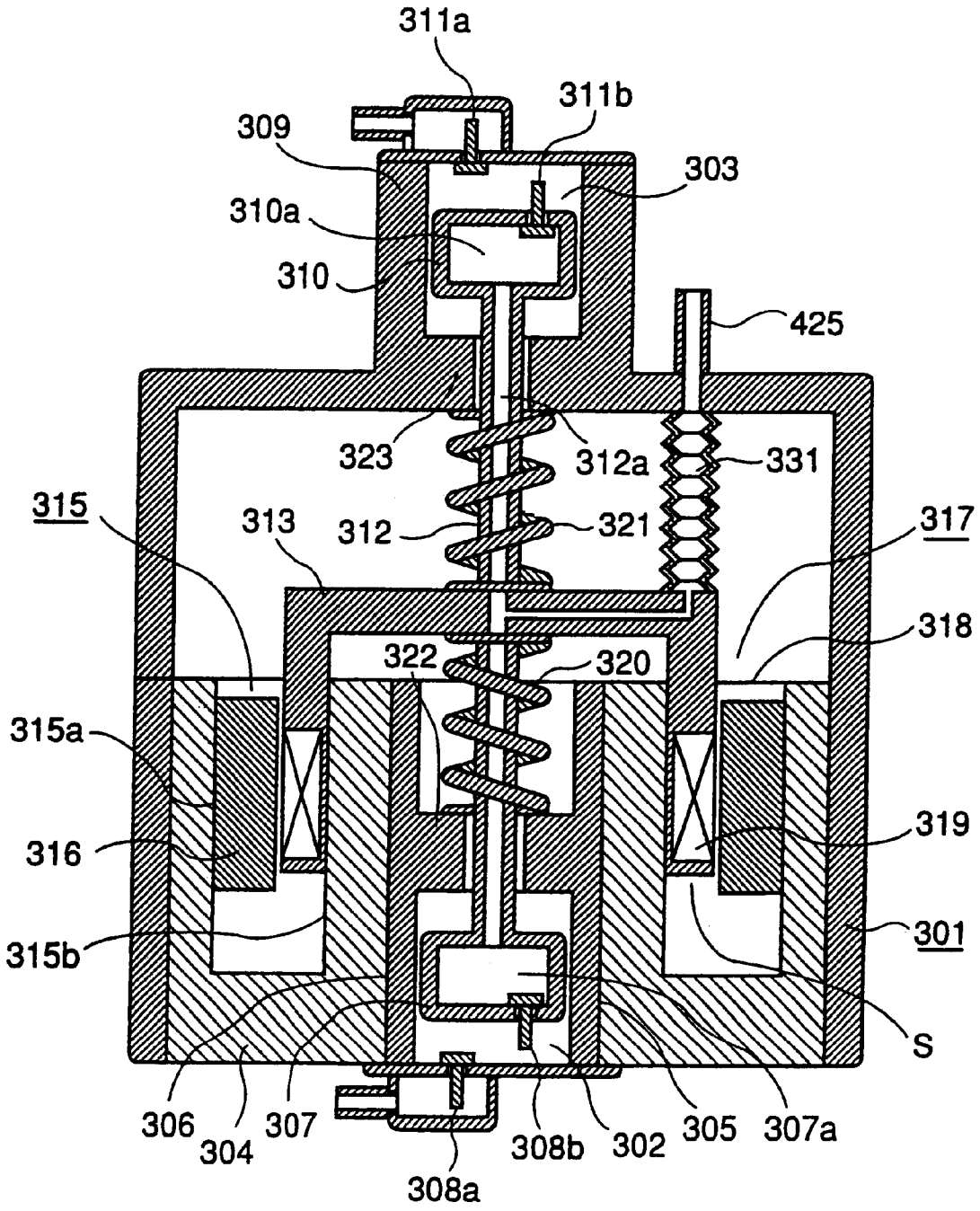
FIG. 16 is a cross sectional view of a linear compressor according to a sixth embodiment of the invention.

A linear compressor according to this embodiment is used as a compressor for a closed type refrigerating system as shown in FIG. 26. The linear compressor has its outer circumference surrounded by a closed cylindrical housing 301 as shown in FIG. 16 and is held as a closed space. Housing 301 has compression chambers 302 and 303 at its lower and upper parts, respectively.

There is formed a magnetic frame (yoke) 304 of a low carbon steel at the lower part of housing 301, a cylinder fitting hole 305 extending in the upward and downward directions is formed through the center of yoke 304, and a first cylinder 306 in a cylindrical shape with a bottom and of a stainless steel is fit into cylinder fitting hole 305.

A first piston 307 is slidably fit into first cylinder 306, and first cylinder 306 and first piston 307 define lower compression chamber 302 serving as a space for compressing refrigerant gas. First cylinder 306 is provided with a first intake valve 308*a* connected with an external gas flow path tube 125 for taking in refrigerant gas evaporated by an evaporator 124.

Meanwhile, a second cylinder 309 extending in the upward and downward directions is provided at the upper part of housing 301 on the opposite side to first cylinder 306, a second piston 310 is slidably fit into second cylinder 309, and second cylinder 309 and second piston 310 define upper compression chamber 303 serving as a space for compressing refrigerant gas. Similarly to lower compression chamber 302, second cylinder 309 is provided with a second intake valve 311*a* connected with external gas flow path tube 125 for taking in refrigerant gas evaporated by evaporator 124.

First and second pistons 307 and 310 are coupled by a piston shaft 312, and a mobile body (bobbin) 313 having a cylindrical shape with a bottom having its side facing first piston 307 opened is integrally fixed at the central position of piston shaft 312. Note that a gas shield member 314 (not shown) such as piston ring is provided at the outer circumferences of first and second pistons 307 and 310.

An annular recess 315 provided concentric with cylinder fitting hole 305 is formed at yoke 304, an annular permanent magnet 316 is attached to the outer side face 315*a* of recess 315 at a prescribed space S to inner side face 315*b*, magnet 316 and yoke 304 form a magnetic circuit 318 for a linear motor 317, and magnetic circuit 318 generates a magnetic field of a prescribed intensity in space S between magnet 316 and the inner side face of recess 315.

Bobbin 313 is provided in space S formed at a part of magnetic circuit 318 formed of magnet 316 and yoke 304, ac current at a prescribed frequency is supplied to an electromagnetic coil 319 wound around the outer circumference of bobbin 313 to move first and second pistons 307 and 310 back and forth within first and second cylinders 306 and 309, respectively, so that gas pressure at a prescribed cycle is generated in lower and upper compression chambers 302 and 303.

Piston shaft 312 is provided with first and second coil springs 320 and 321 for elastically supporting first and second pistons 307 and 310 so that these pistons can move back and forth. More specifically, first coil spring 320 has piston shaft 320 inserted therethrough and is provided between a first spring receiving portion 322 provided at first cylinder 306 and bobbin 313 for pressing and urging,, while second coil spring 321 has piston shaft 312 on the opposite side through bobbin 313 inserted therethrough and is provided between a second spring receiving portion 323 at the lower part of second cylinder 309 and bobbin 313 for pressing and urging. In the linear compressor thus having compression chambers 302 and 303 on both sides, by providing first and second coil spring 320 and 321 on both sides through bobbin 313, the stroke central positions of first and second pistons 307 and 310 can be more readily controlled at a fixed position, and a prescribed spring constant may be established.

Furthermore, first piston 307, second piston 310 and piston shaft 312 are hollow inside, and first piston 307 is provided with a first inlet valve 308*b* for letting out high pressure refrigerant gas compressed by lower compression chamber 302 to the hollow portion 307*a* of first piston 307 and then to a condenser 122. First exhaust valve 308*b* together with first intake valve 308*a* forms a first valve mechanism 308.

Second piston 310 is provided with a second inlet valve 311*b* for letting out high pressure refrigerant gas compressed by upper compression chamber 303 to the hollow portion 310*a* of third piston 310 and then to condenser 122. Second inlet valve 311*b* together with second intake valve 311*a* forms a second valve mechanism 311.

A mobile body space portion 313a having its one end coupled in communication with the hollow portion 312*a* of piston shaft 312 is formed in bobbin 313, and there is provided between the other end and main body housing 301, a communication tube 331 which extends/contracts in association with the upward and downward movement of bobbin 313. Herein, communication tube 331 may be any extensible member such as a bellows type tube and a coil type tube.

Thus, compressed gas from lower compression chamber 302 is let into the hollow portion 307*a* of first piston 307 through first inlet valve 308*b*, and supplied to condenser 122 through the hollow portion 312*a* of piston shaft 312, the mobile space portion 313*a* of bobbin 313, communication tube 331 and gas flow path tube 425. Similarly, compressed gas from upper compression chamber 303 is let out to the hollow portion 310*a* of second piston 310 through second inlet valve 311*b* and then supplied to condenser 122 through the hollow portion 312*a* of piston shaft 312, the mobile space portion 313*a* of bobbin 313, communication tube 331 and gas flow path tube 425.

Figure 17:
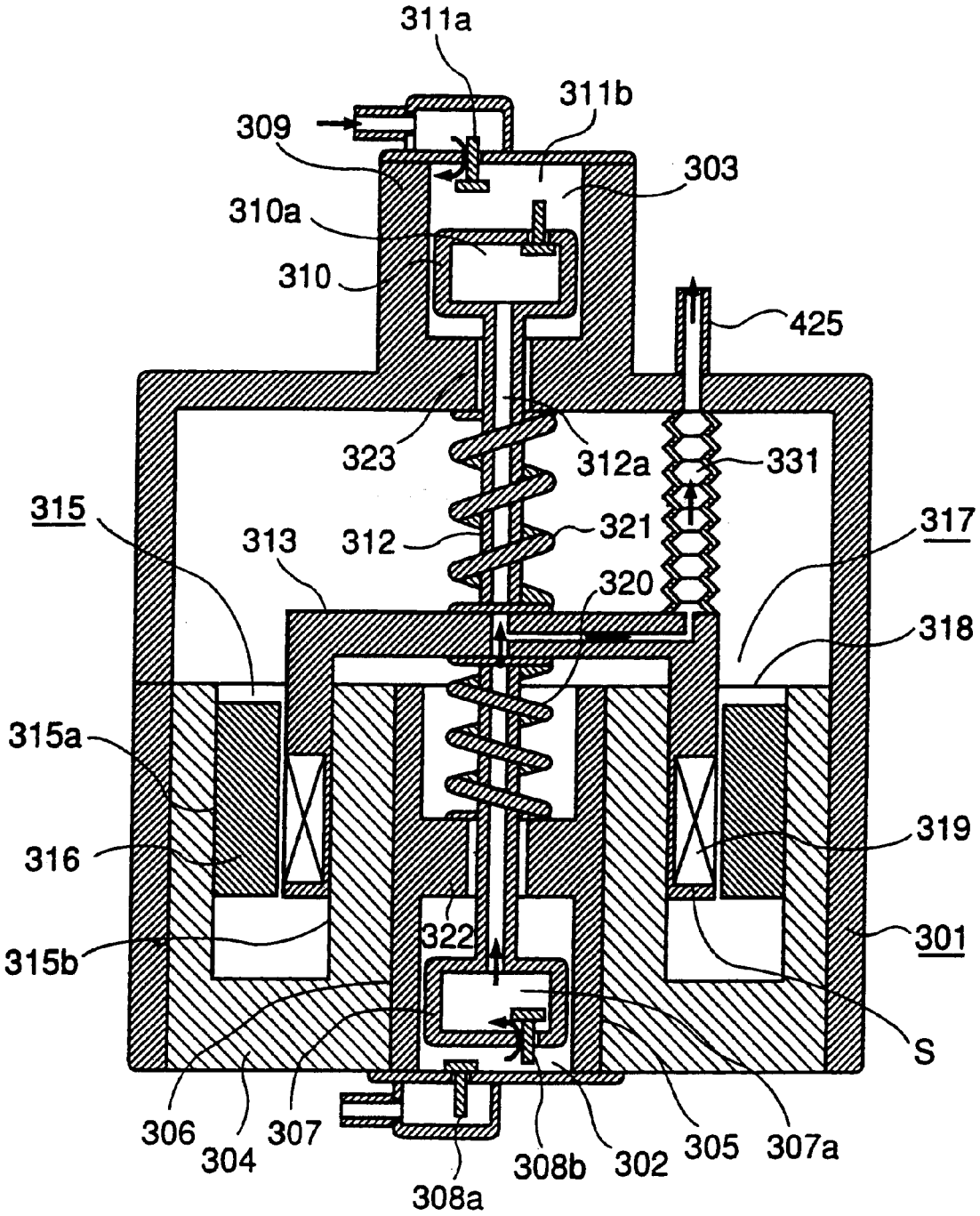
FIG. 17 is a cross sectional view for use in illustration of the operation of the linear compressor in FIG. 16.
Figure 18:
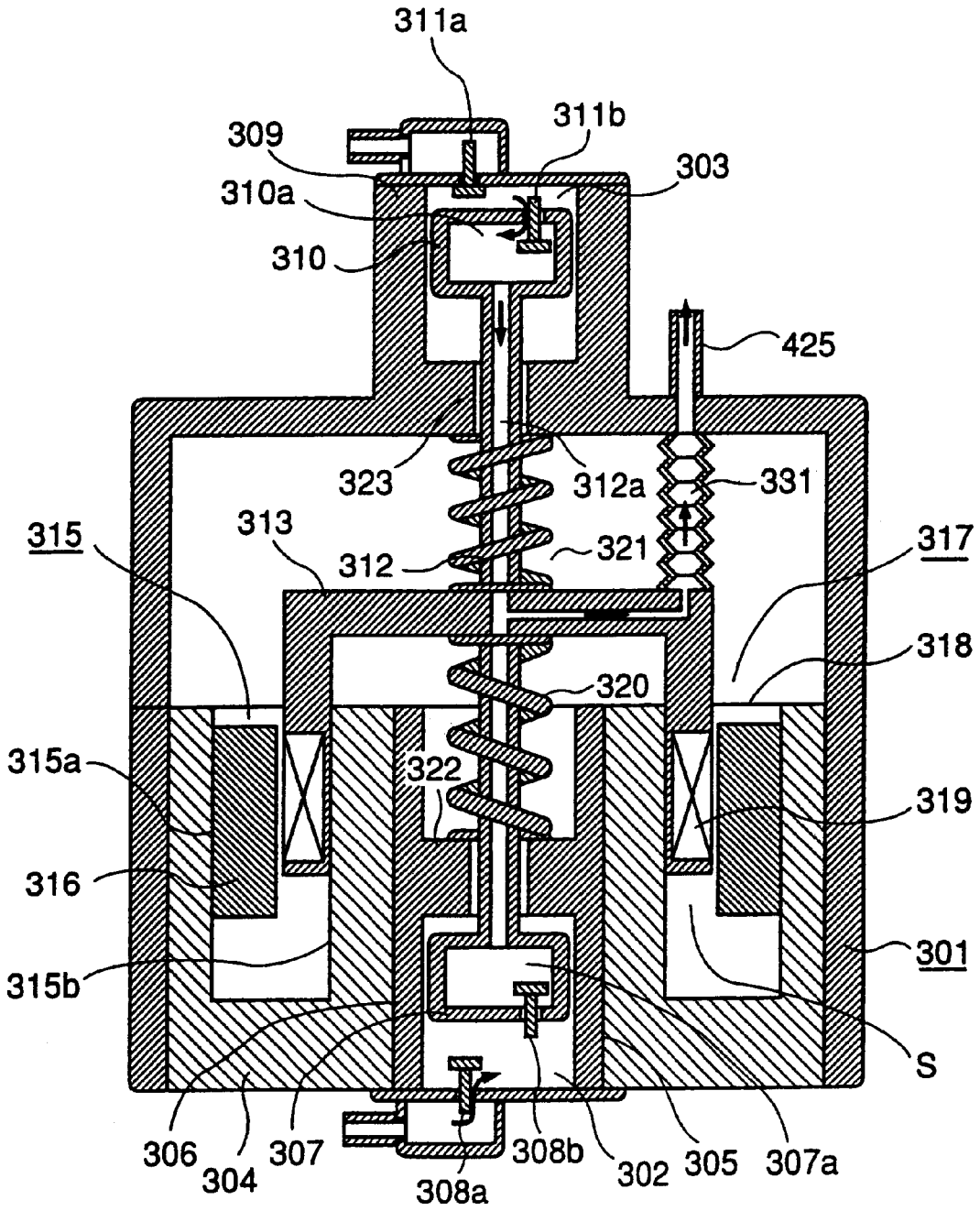
FIG. 18 is a cross sectional view for use in illustration of the operation of the linear compressor in FIG. 16.

FIGS. 17 and 18 are cross sectional views showing how gas is let out from lower and upper compression chambers 302 and 303, respectively. Herein, the arrows indicate the directions of displacement of pistons 307 and 310 and the flow of compressed gas from lower compression chamber 302 and upper compression chamber 303 in association with the movement of pistons 307 and 310.

As can be clearly seen from these figures, in association with the downward movement of first piston 307, compressed gas from lower compression chamber 302 is supplied to condenser 122 through first exhaust valve 308*b*, the hollow portion 307*a* of first piston 307, the hollow portion 312*a* of piston shaft 312, the mobile space portion 313*a* of bobbin 313, communication tube 331 and gas flow path tube 425 (see FIG. 17), while conversely in association with the upward movement of second piston 310, compressed gas from upper compression chamber 303 is supplied to condenser 122 through second exhaust valve 311*b*, the hollow portion 310*a* of second piston 310, the hollow portion 312*a* of piston shaft 312, the mobile space portion 313*a* of bobbin 313, communication tube 331 and gas flow path tube 425 (see FIG. 18).

Thus, first and second inlet valves 308*b* and 311*b* are provided at first and second pistons 307 and 310, respectively in housing 301, exhaust space portions are molded within the housing main body, vibration noises or valve operation noises in tubes caused by gas pulsation may be shielded within housing 301, and it is not necessary to additionally provide an exhaust muffler for preventing noises.

In addition, compressed gas from lower and upper compression chambers 302 and 303 is externally let out from housing 301 through the same communication tube 331, it is not necessary to couple two gas flow path tubes 425 outside housing 301.

Note that first and second spring receiving portions 322 and 323 may be similarly advantageously used as bearings.

Seventh Embodiment

Figure 19:
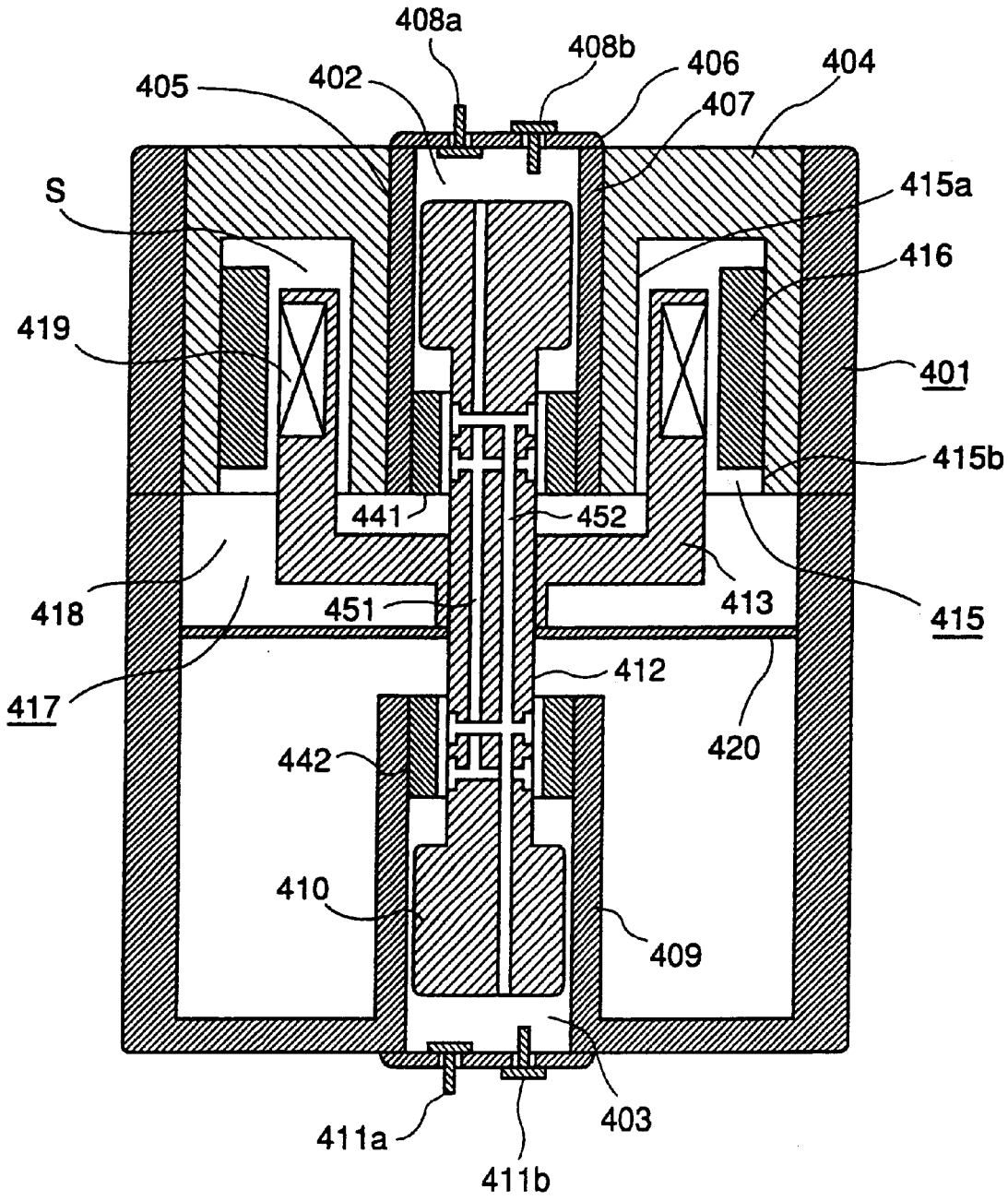
FIG. 19 is a cross sectional view of a linear compressor according to a seventh embodiment of the invention.

A linear compressor according to this embodiment is used as a compressor for a closed type refrigerating system as shown in FIG. 26. The compressor has its outer circumference surrounded by a closed type cylindrical housing 401 as shown in FIG. 19, and is held as a closed space. Housing 401 has compression chambers 402 and 403 at its lower and upper parts.

A magnetic frame (yoke) 404 of a low carbon steel is formed at the upper part of housing 401, a cylinder fitting hole 405 extending in the vertical directions is inserted through the center of yoke 404, and a first cylinder 406 having a cylindrical shape with a bottom and formed of a stainless steel is fit into cylinder fitting hole 405.

A first piston 407 is fit in first cylinder 406 through a fine space and capable of moving back and forth, and first cylinder 406 and first piston 407 define upper compression chamber 402 serving as a space for compressing refrigerant gas. First cylinder 406 is provided with a first intake valve 408*a* connected with an external gas flow path tube 125 (see FIG. 26) for taking in refrigerant gas evaporated by an evaporator 124.

Meanwhile, a second cylinder 409 extending in the vertical direction is provided at the lower part of housing 401 on the opposite side to first cylinder 406, a second piston 410 is fit in second cylinder 409 through a fine space and capable of moving back and forth, and second cylinder 409 and second piston 410 define lower compression chamber 403 serving as a space for compressing refrigerant gas. Similarly to upper compression chamber 402, second cylinder 409 is provided with a second intake valve 411*a* connected with external gas flow path tube 125 (see FIG. 26) for taking in refrigerant gas evaporated by evaporator 124.

First and second pistons 407 and 410 are coupled by a piston shaft 412, and a mobile body (bobbin) 413 having a cylindrical shape with a bottom and its side facing first piston 407 opened is integrally fixed at the central position of piston shaft 412.

An annular recess 415 provided concentric with cylinder fitting hole 405 is formed at yoke 404, an annular permanent magnet 416 is attached to the outer side face 415*a* of recess 415 at a prescribed space S to inner side face 415*b*. Magnet 416 an yoke 404 form a magnetic circuit 413 for a linear motor 417, and magnetic circuit 418 generates a magnetic field of a prescribed intensity in space S between magnet 416 and the inner side face of recess 415.

Bobbin 413 is provided in space S formed at a part of magnetic circuit 418 formed of magnet 416 and yoke 404, ac current at a prescribed frequency is supplied to an electromagnetic coil 419 wound around the outer circumference of bobbin 413 to move back and forth first and second pistons 407 and 410 in first and second cylinders 406 and 409, respectively, so that gas pressure at a prescribed cycle is generated in upper and lower compression chambers 402 and 403.

Figure 28:
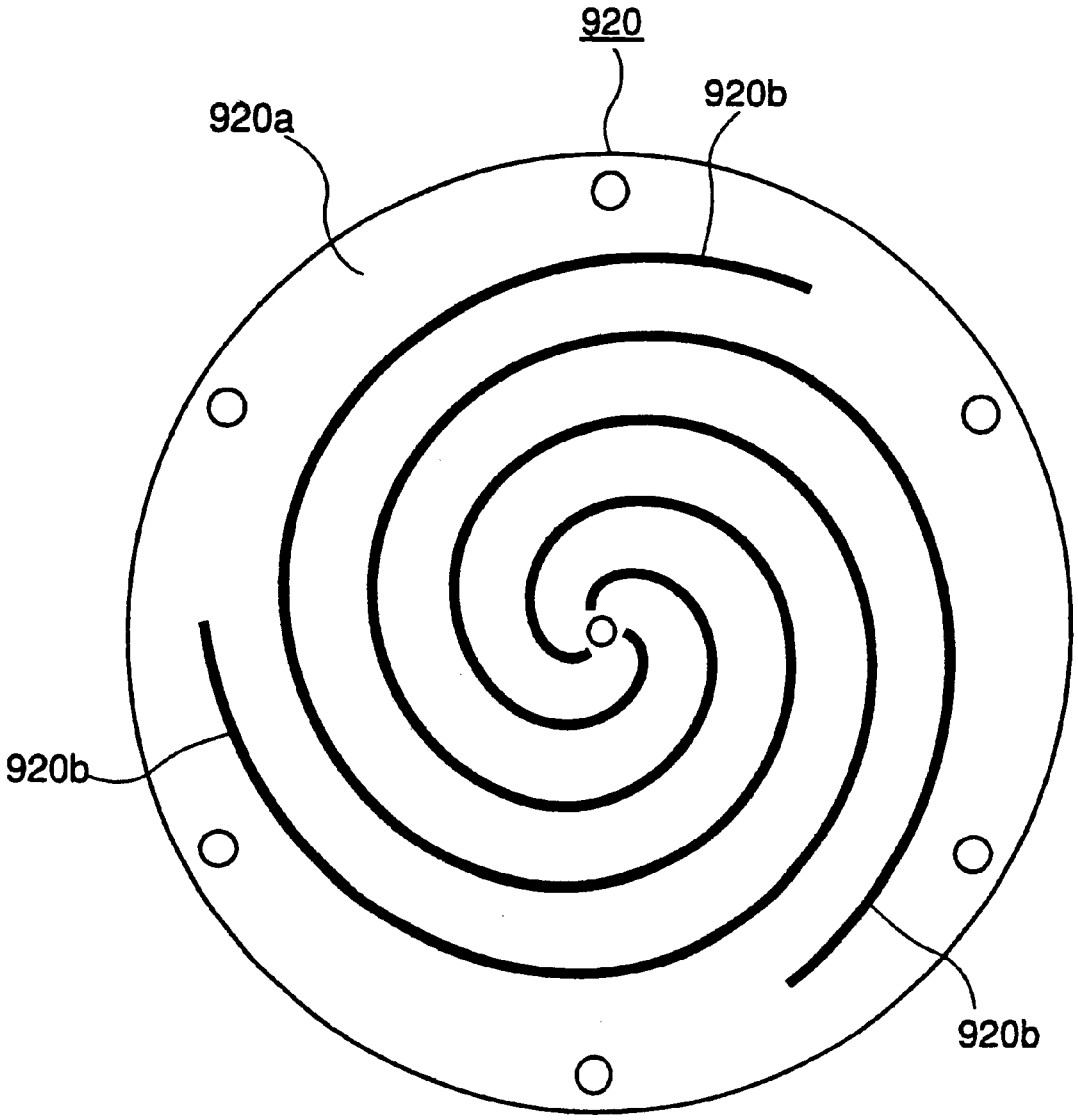
FIG.28 PRIOR ART
FIG. 28 is a top view showing the shape of a suspension spring.

Piston shaft 412 is provided with a plate shaped suspension spring 420 for elastically supporting first and second pistons 407 and 410 such that they can move back and forth. Suspension spring 420 has its central portion integrally fixed to the central position of piston shaft 412, and its outer circumference fixed to housing 401, and elastically supports first and second pistons 407 and 410 such that these pistons can move back and forth. Note that suspension spring 420 is formed of a spring steel, and its specific shape is similar to that described by referring to FIG. 28, and therefore a detailed description thereof will not be provided here.

In the linear compressor thus having compression chambers 402 and 403 on both sides, by providing suspension spring 420 at the central position of piston shaft 412, the stroke central positions of first and second pistons 407 and 410 can be more readily controlled at a fixed position.

Furthermore, first piston 407 and piston shaft 412 are provided with a first communication path 451 for supplying compressed gas from upper compression chamber 402 in first cylinder 406 to first and second gas bearing portions 441 and 442 which will be described, while second piston 420 and piston shaft 412 are provided with a second communication path 452 for supplying compressed gas from lower compression chamber 403 in second cylinder 409 to first and second gas bearing portions 441 and 442.

In first and second gas bearing portions 441 and 442, in a compression step as first piston 407 is positioned near the upper supporting point, a part of compressed gas from upper compression chamber 402 in first cylinder 406 is ejected through first communication path 451 to the bearing side from piston shaft 412, while in a compression step as second piston 410 is positioned near the upper supporting point, a part of compressed gas from lower compression chamber 403 in second cylinder 409 is ejected through second communication path 452 to the bearing side.

Thus, when first and second pistons 407 and 410 are positioned near the upper and lower supporting points, suspension spring 420 is fully extended, and therefore suspension spring 420 cannot sufficiently control the deviation of the axes of pistons, but instead, the deviation of axes of the first and second pistons 407 and 410 can be surely prevented by first and second gas bearing portions 441 and 442.

In this structure, during the period in which first piston 407 is positioned near the upper supporting point, the pressure difference between upper compression chamber 402 and gas bearing portions 441 and 442 is increased, a part of compressed gas from upper compression chamber 402 is supplied to first and second gas bearing portions 441 and 442 through first communication path 451, and compressed gas is blown toward the bearing side from piston shaft 412.

Meanwhile, during the period in which second piston 410 is positioned near the upper supporting point, the pressure difference between lower compression chamber 403 and gas bearing portions 441 and 442 is increased, a part of compressed gas from lower compression chamber 403 is supplied to first second gas bearing portions 441 and 442 through second communication path 452, and compressed gas is blown toward the bearing side from piston shaft 412.

Figure 20:
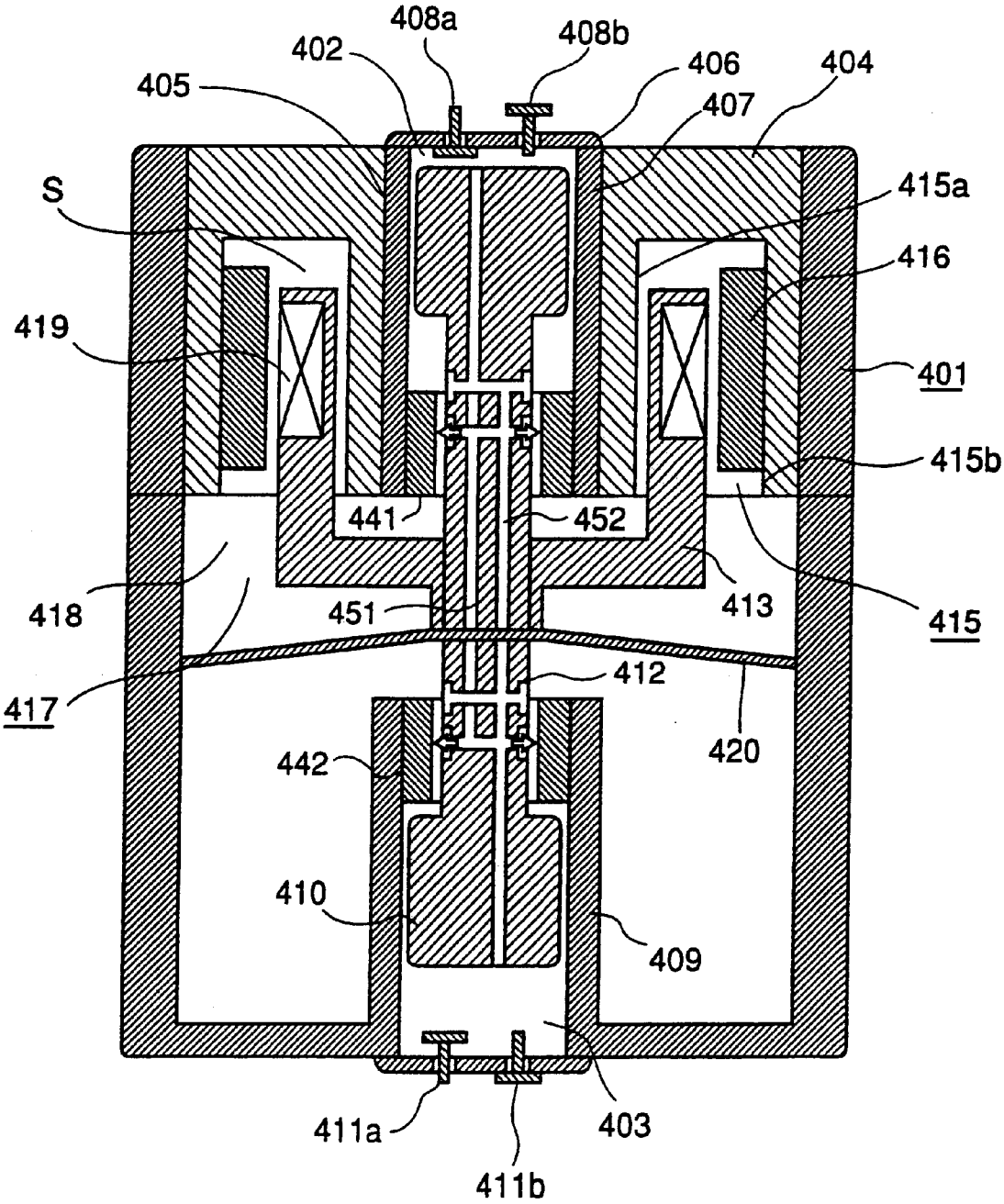
FIG. 20 is a cross sectional view for use in illustration of the content of the operation as first piston 407 in the linear compressor shown in FIG. 19 moves to the vicinity of the upper supporting point.
Figure 21:
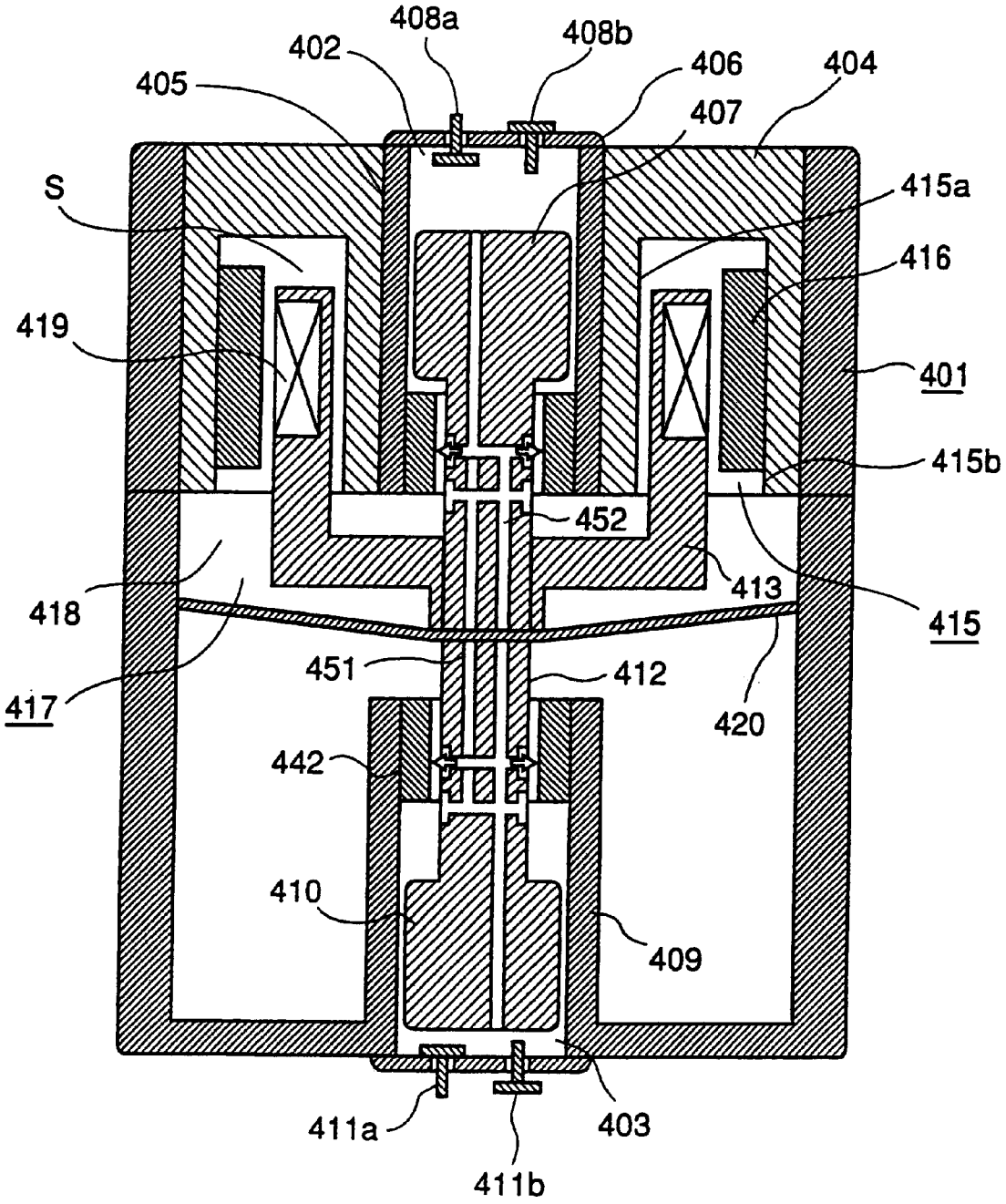
FIG. 21 is a cross sectional view for use in illustration of the content of the operation as second piston 410 in the linear compressor shown in FIG. 19 moves to the vicinity of the upper supporting point.

FIGS. 20 and 21 are cross sectional view showing how gas is let out from upper and lower compression chambers 402 and 403, respectively. Herein, the arrows indicate the direction of displacement of pistons 407 and 410, and the flow of compressed gas from upper and lower compression chambers 402 and 403 in association with the movement of pistons 407 and 410.

As can be clearly seen from these figures, in association with the movement of first piston 407 toward the vicinity of the upper supporting point, compressed gas from upper compression chamber 402 is supplied to first and second gas bearing portions 441 and 442 through first communication path 451 (see FIG. 20), while conversely in association with the movement of second piston 410 toward the vicinity of the upper supporting point, a part of compressed gas from lower compression chamber 403 is supplied to first and second bearing portions 441 and 442 through second communication path 452 (see FIG. 21).

While first and second pistons 407 and 410 are positioned at the neutral point, the pressure differences between compression chambers 402 and 403 and gas bearing portions 441 and 442 are reduced, compressed gas is not blown toward the side of bearings from piston shaft 412, and therefore gas bearing portions 441 and 442 may not bring about sufficient effects, but in this case, suspension spring 412 restricts the axial positions of first and second pistons 407 and 410. As a result, the efficiency of the device associated with compressed gas supply from compression chambers 402 and 403 can be improved as much as possible.

Therefore when first and second pistons 407 and 410 are positioned near the neutral points, suspension spring 412 restricts the axial positions of first and second pistons 407 and 410, while when first and second pistons 407 and 410 are positioned near the upper supporting point, the above-described first and second gas bearing portions 441 and 442 restrict the axial positions of first and second pistons 407 and 410, thus the stroke central positions of pistons 407 and 410 may be stabilized with such a simple structure, while the deviation of the axes of pistons 407 and 410 as pistons 407 and 410 move back and forth may be limited to prevent abrasion at the piston portion, which leads to a longer life of the device.

Note that first and second communication paths 451 and 452 are provided at first piston 407, second piston 410 and piston shaft 412 in the above-described embodiment, but alternatively these communication paths 451 and 452 may be formed in first cylinder 406, second cylinder 409 and housing 401, and compressed gas may be ejected from the side of cylinders 406 and 409 toward piston shaft 412.

Eighth Embodiment

The structure of a linear compressor according to this embodiment will be now described in conjunction with the accompanying drawings.

Figure 22:
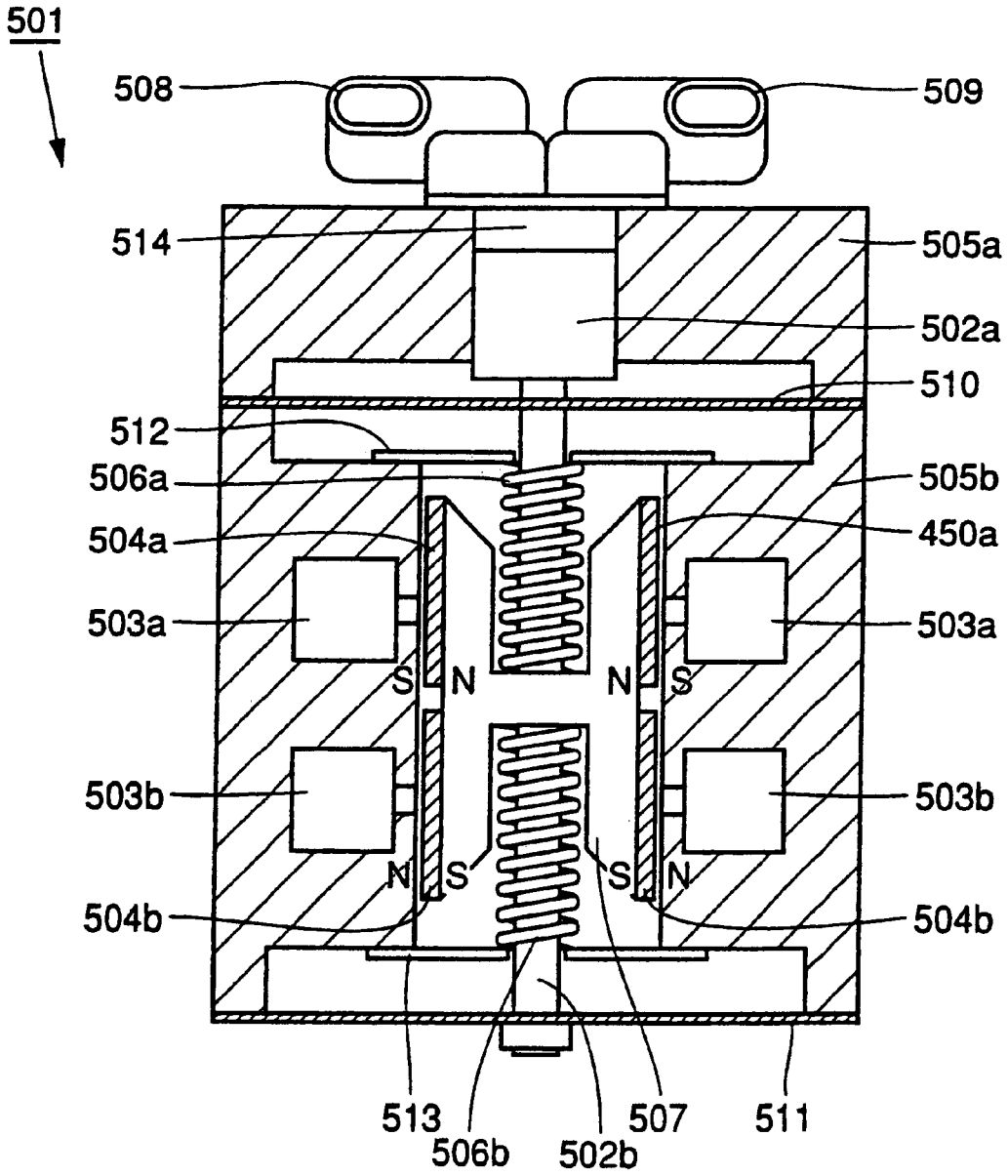
FIG. 22 is a cross sectional view showing the structure of a linear compressor according to an eighth embodiment of the invention.

Referring to FIG. 22, the structure of linear compressor 501 according to this embodiment will be described. FIG. 22 is a cross sectional view of magnet mobile type linear compressor 501, in which the piston is positioned at the neutral point.

Linear compressor 501 has cylinder 505*a* having a compression chamber 514 and a cylindrical casing 505*b* which are integrally formed. Compression chamber 514 is provided with a piston 502*a* for compressing refrigerant gas, and a shaft is fit into piston 502*a*. There are provided an intake muffler 508 and an exhaust muffler 509 at the upper part of compression chamber 514.

A magnet base 507 having an approximately H shaped longitudinal section is attached to shaft 502*b*. Permanent magnets 504*a* and 504*b* are attached to the outer side of the magnet base in upper and lower two stages. Upper permanent magnet 504*a* is provided such that its outer side has south pole, and lower permanent magnet 504*b* is provided such that its outer side has north pole.

In a casing 505*b* opposite to permanent magnets 504*a* and 504*b*, a coil 503*a* is provided to surround permanent magnet 504*a*, and a coil 503*b* is provided to surround permanent magnet 504*b*. Permanent magnets 504*a* and 504*b* and coils 503*a* and 503*b* form a linear motor to provide piston 502*a* with upward and downward movements.

Suspension springs 510 and 511 of thin plates for preventing the deviation of the axis of shaft 502*b* are attached to the upper and lower positions of shaft 502*b*. Various shapes may be selected for the two-dimensional shapes of suspension springs 510 and 511 such as a spiral shape or a cross shape.

In the inner space defined by the magnet base 507 of shaft 502*b*, there are provided coil springs 506*a* and 506*b* for always returning departed piston 502*a* to the neutral point. Coil springs 506*a* and 506*b* have their one ends supported by magnet base 507, and the other ends supported by supporting plates 512 and 513, respectively. Herein, linear compressor 501 has a resonant frequency determined by the weights of piston 502*a* and shaft 502*b*, the spring constants of suspension springs 510 and 511, the spring constants of coil springs 506*a* and 506*b* and the spring component of compressed gas or the like. Therefore, driving the linear motor at the resonant frequency permits compressed gas to be efficiently produced.

Figure 23:
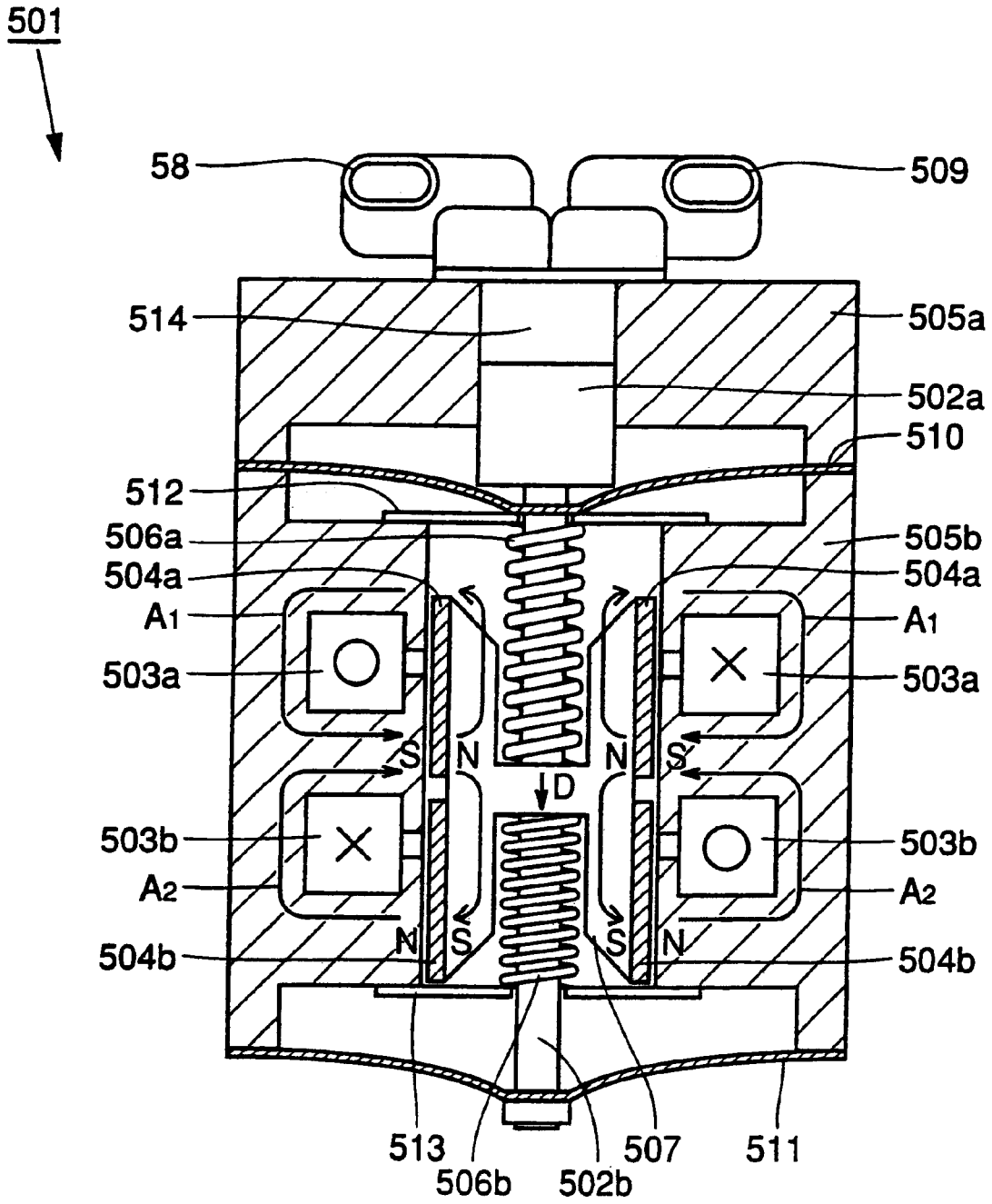
FIG. 23 is a cross sectional view showing the step of re-expansion/taking by the linear compressor according to the eighth embodiment of the invention.
Figure 24:
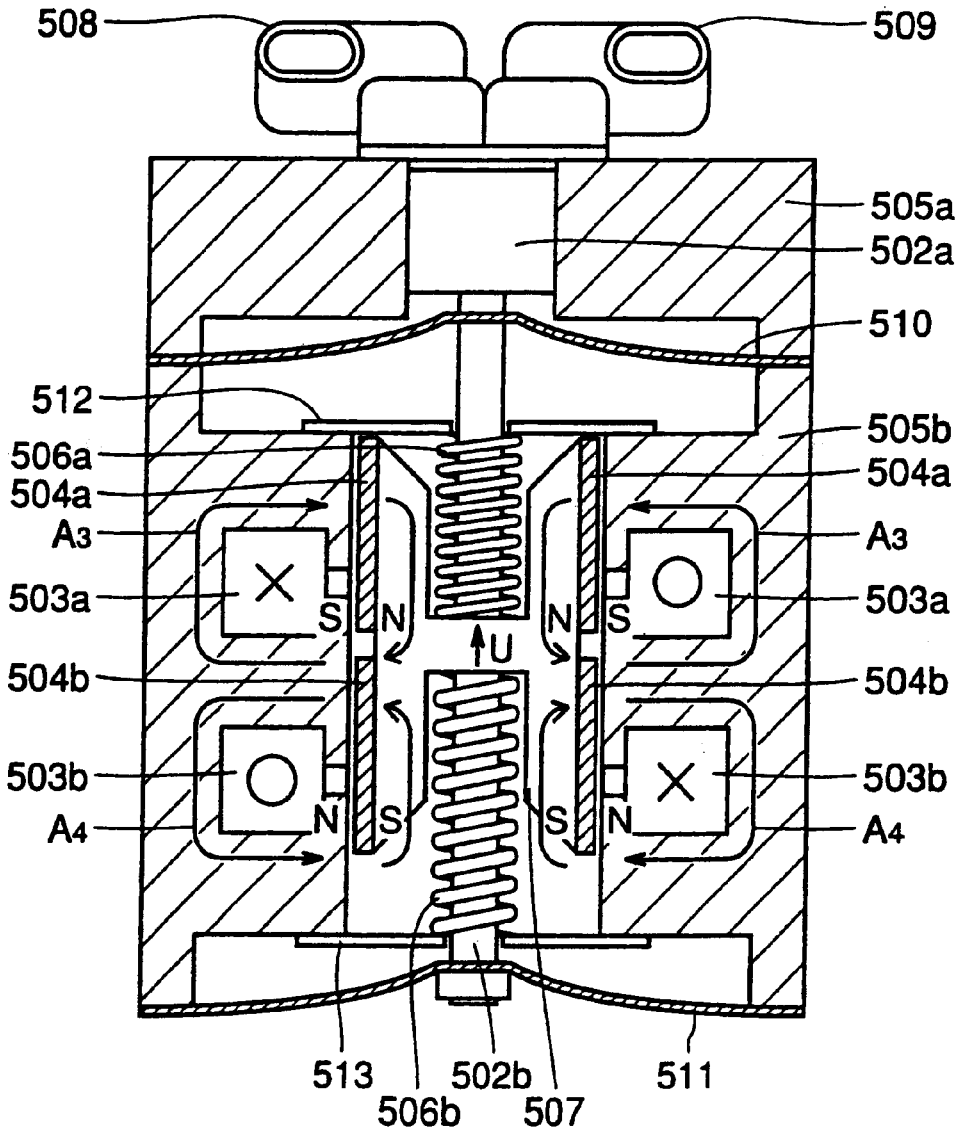
FIG. 24 is a cross sectional view showing the step of compression/exhaustion by the linear compressor according to the eighth embodiment of the invention.

The operation of the device with linear compressor 501 having the above-described structure will be now described in conjunction with FIGS. 23 and 24. FIG. 23 shows the step of re-expansion/in taking, while FIG. 24 shows the step of compression/exhaustion.

Referring to FIG. 23, coil 503*a* is supplied with current which passes anticlockwise when viewed from the side of piston 502*a*, and coil 503*b* is supplied with current which passes clockwise when viewed from the side of piston 502*a*. Thus, a magnetic field is generated for coil 503*a* in the direction indicated by arrow A1, and a magnetic field is generated for coil 503*b* in the direction indicated by arrow A2. As a result, downward forces (in the direction by arrow D) are imposed on permanent magnets 504*a* and 504*b* to cause piston 502*a* to move downward.

Now referring to FIG. 24, coil 503*a* is supplied with current which passes clockwise when viewed from the side of piston 502*a*, and coil 503*b* is supplied with current which passes anticlockwise when viewed from the side of piston 502*a*. Thus, a magnetic field is generated for coil 503*a* in the direction indicated by arrow A3, and a magnetic field is generated for coil 503*b* in the direction indicated by arrow A4. As a result, upward forces (in the direction indicated by arrow U) are generated for permanent magnets 504*a* and 504*b* to cause piston 502*a* to move upward.

Thus, the steps shown in FIGS. 23 and 24 are sequentially repeated to generate compressed gas in compression chamber 514.

As described above, in the linear compressor having the structure shown in FIG. 22, in an application to a magnet mobile type linear motor, by providing suspension springs 510 and 511 at the upper and lower part of shaft 502*b* for preventing the deviation of axis of shaft 502*b*, the deviation of axis of shaft 502*b* is prevented. Thus, loses in the driving force caused by friction between piston 502*a* and cylinder 505*a* is prevented, which leads to improvement of the efficiency.

Furthermore, the longitudinal section of magnet base 507 used for the linear motor has an H shape, and therefore the inner space formed by magnet based 507 accommodates coil springs 506*a* and 506*b*. As a result, the inner space of the linear compressor is efficiently used, which leads to reduction in the size of the linear compressor.

Note that only suspension springs 510 and 511 may be provided by making suspension spring 510 and 511 play the roles of coil springs 506*a* and 506*b* as well, but increasing the spring constants of suspension springs 510 and 511 are more likely to cause destruction by mechanical wear. As a result, the above-described structure employing both coil springs 506*a* and 506*b* and suspension springs 510 and 511 would be most preferable.

Ninth Embodiment

Figure 25:
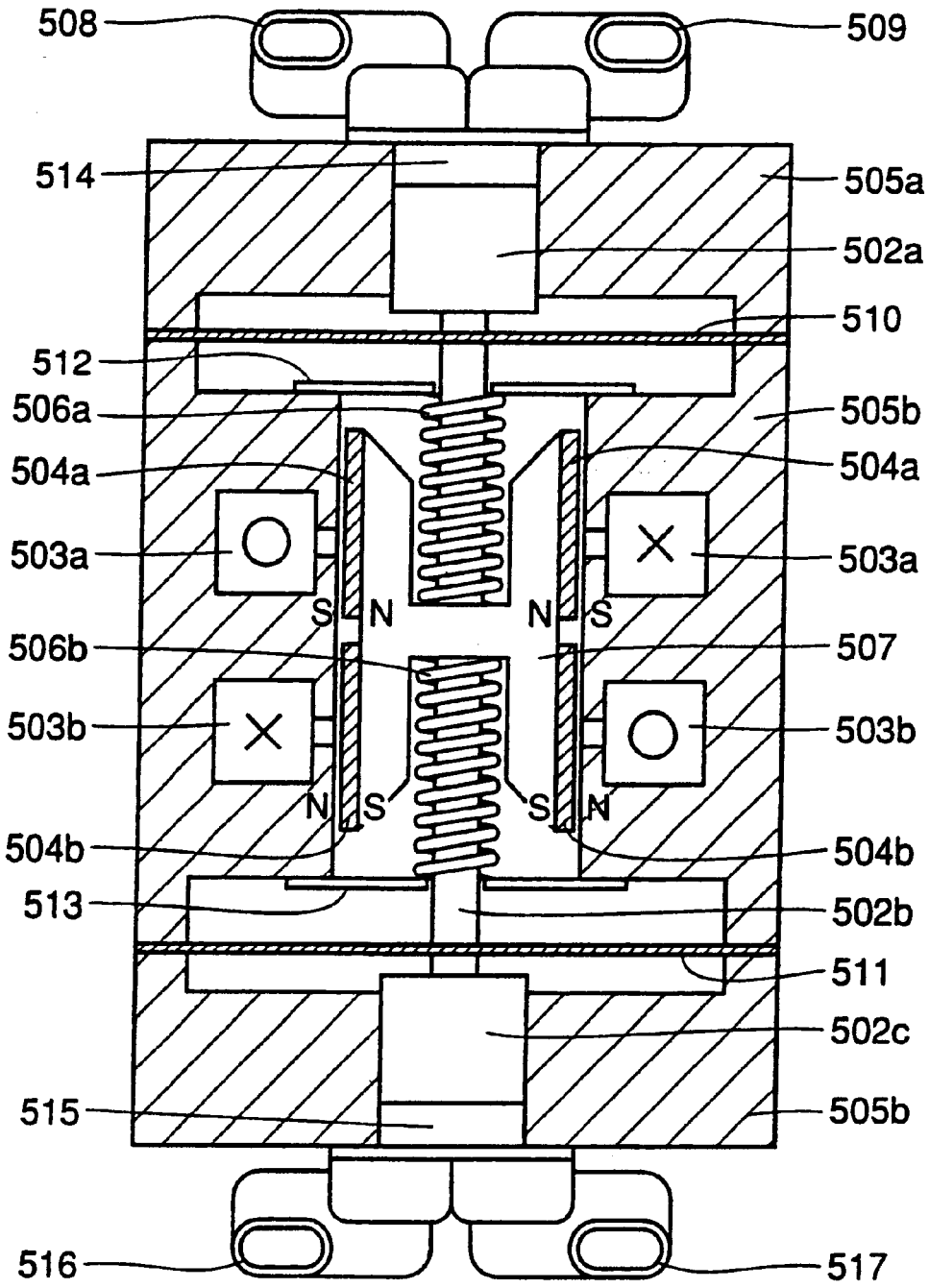
FIG. 25 is a lengthwise section of the structure of a linear compressor according to a ninth embodiment of the invention.

In the eighth embodiment as described above, the case of providing only one cylinder is described, but as shown in FIG. 25, for example, by providing a cylinder 505*b* having a compression chamber 515 at its lower end portion and providing a piston 502*b* at the lower end side of shaft 502*b*, to form a two-piston type linear compressor, the same function and effects by the single piston type linear compressor described above may be brought about. Application of the structure to the coil-mobile type linear compressor may bring about the same function and effects.

The disclosed embodiments herein are by all means by the line way of illustration and should not be taken to be limitative. The scope of the invention is limited by the scope of claims for patent rather than by the above-description of the invention, and the modifications having equivalent meanings to and within the range of the scope of claims for patent are intended to be included.

INDUSTRIAL APPLICABILITY

As in the foregoing, the linear compressor according to the invention is applicable to a linear compressor used for a close type refrigerating system.

What is claimed is:

1. A linear compressor for generating compressed gas, comprising:

a shaft having a piston;

a cylinder having a compression chamber accommodating said piston;

a body defining said cylinder for accommodating said shaft;

a linear motor defined by fixed and movable members coupled to said shaft and said body, respectively, for providing said piston with reciprocating movement, thereby generating said compressed gas in said compression chamber;

a first elastic member connected between said shaft and said body for returning said piston departed from a neutral point to said neutral point; and a second elastic member connected between said shaft and said body operative to prevent axial deviation of said shaft.

2. The linear compressor as recited in claim 1, wherein a vibrating portion including said pisiton, said shaft, said first elastic member, said second elastic member and said compressed gas has a prescribed resonant frequency, and said linear motor drives said shaft to move back and forth at said resonant frequency.

3. The linear compressor as recited in any one of claims 1 and 2, wherein said linear motor has a coil fixedly disposed in said body and a permanent magnet fixed to said shaft, and said first elastic member is accommodated within an inner space provided at said permanent magnet.

4. The linear compressor as recited in any one of claims 1 to 3, wherein said first elastic member is a coil spring, and said second elastic member is a suspension spring.

* * * * *